US005413180A

United States Patent [19]

Ross et al.

[11] Patent Number: 5,413,180

[45] Date of Patent: May 9, 1995

[54] ONE TRIP BACKWASH/SAND CONTROL SYSTEM WITH EXTENDABLE WASHPIPE ISOLATION

[75] Inventors: Colby M. Ross, Carrollton; Henry L. Restarick, Plano; Ralph H. Echols, III, Carrollton; Phillip T. Thomas, Lewisville; Dhirajlal C. Patel, Carrollton, all of Tex.

[73] Assignee: Halliburton Company, Houston, Tex.

[21] Appl. No.: 99,857

[22] Filed: Jul. 30, 1993

Related U.S. Application Data

[63] Continuation-in-part of Ser. No. 1,020, Jan. 6, 1993, Pat. No. 5,332,045, which is a continuation of Ser. No. 743,792, Aug. 12, 1991, Pat. No. 5,180,016.

[51] Int. Cl.[6] ..... E21B 23/04

[52] U.S. Cl. ..... 166/387; 166/194; 166/239

[58] Field of Search ..... 166/387, 120, 122, 157, 166/188, 192, 193, 194, 202, 318, 326, 238, 239, 195

[56] References Cited

U.S. PATENT DOCUMENTS

| | | | |
|---|---|---|---|
| 2,659,438 | 11/1953 | Schnitter | 166/194 X |
| 3,211,232 | 10/1965 | Grimmer | 166/194 |
| 3,455,387 | 7/1969 | Peters | 166/278 |
| 3,552,412 | 1/1971 | Hager et al. | 166/194 X |
| 3,912,026 | 10/1975 | Crowe et al. | 166/239 X |
| 4,253,522 | 3/1981 | Setterberg | 166/278 |
| 4,436,155 | 3/1984 | Brieger | 166/297 |
| 4,540,051 | 9/1985 | Schmuck et al. | 166/278 |
| 4,541,484 | 9/1985 | Salerni et al. | 166/278 |
| 4,541,486 | 9/1985 | Wetzel et al. | 166/297 |
| 4,566,538 | 1/1986 | Peterson | 166/278 |
| 4,576,236 | 3/1986 | Stout et al. | 166/386 |
| 4,591,750 | 8/1990 | Wetzel | 166/278 |
| 4,605,074 | 8/1986 | Barfield | 175/4.52 |
| 4,635,725 | 1/1987 | Burroughs | 166/278 |
| 4,823,882 | 4/1989 | Stokley et al. | 166/387 |
| 4,893,678 | 1/1990 | Stokley et al. | 166/374 |
| 4,944,348 | 7/1990 | Whiteley | 166/278 |
| 4,949,793 | 8/1990 | Rubbo et al. | 166/382 |
| 5,137,090 | 8/1992 | Hare et al. | 166/325 |
| 5,159,981 | 11/1992 | Le | 166/325 |
| 5,174,379 | 12/1992 | Whiteley | 166/278 |

*Primary Examiner*—William P. Neuder

*Attorney, Agent, or Firm*—Tracy W. Druce; Dennis T. Griggs

[57] ABSTRACT

A travel joint and latching assembly is connected below a gravel pack service tool to set an isolation assembly while performing backwashing and gravel pack operations, in a single trip. The travel joint is protected against inadvertent expansion by a positive mechanical lock assembly which isolates and decouples mechanical loading forces which may arise during the setting of the packer and during gravel pack operations. Inadvertent set of the hydraulic packer during backwashing operations is prevented by a hydraulic setting tool which includes a shear sleeve and an expandable C-ring drop ball seat.

23 Claims, 11 Drawing Sheets

RUN

RELEASE & EXPAND
TRAVEL JOINT

LAND & LATCH
WASHPIPE

ONE TRIP BACKWASH/SAND CONTROL SYSTEM WITH EXTENDABLE WASHPIPE ISOLATION

CROSS REFERENCE TO RELATED APPLICATIONS

This application is a continuation-in-part of application U.S. Ser. No. 08/001,020, filed Jan. 6, 1993, now U.S. Pat. No. 5,332,045, which is a continuation of U.S. Ser. No. 07/743,792, filed Aug. 12, 1991, now U.S. Pat. No. 5,180,016.

FIELD OF THE INVENTION

This invention relates generally to method and apparatus for completing wells, and in particular to method and apparatus for isolating a production interval during backwashing and sand control operations performed prior to placing the well on production.

1. Background of the Invention

In the course of completing an oil and/or gas well, it is common practice to run a string of protective casing into the well bore and then to run a string of production tubing inside the casing. At the well site, the casing is perforated across one or more production zones to allow production fluids to enter the casing bore. During production of the formation fluid, formation sand is also swept into the flow path. The formation sand is relatively fine sand that erodes production components in the flow path.

In some completions, however, the well bore is uncased, and an open face is established across the oil or gas bearing zone. Such open bore hole (uncased) arrangements are utilized, for example, in water wells, test wells, highly deviated and horizontal well completions. One or more sand screens are installed in the flow path between the production tubing and the uncased well bore face. The packer and sand screens are run in place while water is pumped under high pressure through a float shoe to wash the uncased bore, remove drill cuttings and clean the well completion apparatus prior to placing the well into production. It is sometimes desirable that the wash job be performed as the completion apparatus is run into the well. After the annulus along the uncased well bore has been cleaned, the packer is customarily set and sand control operations are performed within the annulus in the zone where production fluids flow into the production tubing.

In a gravel pack operation, a service seal unit mounted on work string is reciprocated relative to certain flow ports and sealing points within a packer bore to route service fluid along various passages. The service seal unit carries vertical and lateral circulation passages which, when aligned with ports formed in the packer, permit service fluid such as acids, polymers, cements, sand or gravel laden liquids to be injected into a formation through the bore of the work string and into the outer annulus between a sand screen and the perforated well casing, thereby avoiding plugging or otherwise damaging the sand screen.

2. Description of the Prior Art

The damaging effects to the formation that result from exposure to lost circulation completion fluids are well known. The duration a formation is exposed to completion fluids may be critical to the eventual success of a well. Many gravel-packed wells are in a fluid-loss condition during completion operations, and this allows expensive completion fluids to escape into the formation.

Other wells are completed with chemical fluid loss control materials in place or are prepacked to prevent uncontrolled fluid loss. The ability to wash out or through these materials is important to the eventual success of the completion. These problems can be further complicated when multiple trips are required for each phase of the completion and stimulation of each interval.

According to conventional practice, various completion operations have been accomplished by multiple trips into the well bore. In addition, effective well control has required the use of mechanical or chemical control methods during the trips. Rig time (trip time) has been, and still is, a significant part of the completion cost.

Chemical fluid-loss methods (pills) are effective when used to isolate short intervals. The chemicals, however, must be removed or chemically broken to regain permeability of the formation. The problems of well clean up and formation compatibility are of major concern.

OBJECTS OF THE INVENTION

The principal object of the present invention is to provide a one-trip backwash/sand control system for preventing the loss of incompatible service fluids into the surrounding formation during backwashing and gravel packing operations.

Another object of the invention is to provide a shifting tool which will retract through restricted bores and shift sleeves larger than the bore size of the assembly.

Another object of the invention is to provide a means to run down hole completion equipment into a well simultaneously with the washing of a sand screen into place without risk of premature set or unintentional operation of packers and other hydraulically operated tools which comprise a part or all of the completion equipment.

Another object of the invention is to provide apparatus that positively locks the washing assembly to the washpipe, while allowing the washing assembly to expand so that it can be latched into place and shearably released from a washpipe.

SUMMARY OF THE INVENTION

The foregoing objects are achieved according to the present invention by a travel joint and locking assembly which is connected to a washpipe/isolation tubing string below the gravel pack service tool to backwash, perform sand control operations, and land a washing tool in a single trip. A positive mechanical lock isolates shear pins on the travel joint and the connection between the service tool and the washpipe string with respect to any tensile forces which may arise during the setting of the packer and during sand control/washing operations.

According to one embodiment of the invention, the packer setting tool includes a shear sleeve which covers setting ports and prevents inadvertent entry of hydraulic setting pressure into the hydraulic production packer. The setting apparatus has a production mandrel adapted for coupling and flow registration with the flow bore of the packer. The setting tool mandrel is mechanically coupled to the mandrel of the packer by a guide collar which provides a enlarged counterbore chamber. The guide collar is intersected by radial setting ports which permit the entry of pressurized fluid for pressurizing the hydraulic pressure chamber of the packer. A shiftable ball seat opens the setting ports in cooperation with a drop ball. The C-ring ball seat is a radially outwardly biased split C-ring which engages against the shear sleeve. According to this arrangement, the setting ports remain sealed by the shear sleeve while running the packer and completion apparatus into the well bore, and while circulating debris by high pressure jet flow backwash through the annulus to the surface. Since the setting ports are sealed until the drop ball is flowed into place, the jet washing may proceed and there is no risk of prematurely setting the packer, even though the annulus may be blocked by debris.

According to another aspect of the present invention, an improved flapper valve assembly is provided which permits torquing operations through the valve seat sub while isolating the flapper valve and hinge assembly. The flapper valve closure element is held in the open position by a prop sleeve. The prop sleeve is releasably secured to the valve seat by shear pins, and is not connected to the flapper housing. According to this arrangement, torque applied through the work string and flapper valve housing is decoupled from the prop sleeve, thereby removing torque differential forces across the prop sleeve and the valve seat housing which might damage the flapper valve hinge assembly.

According to another aspect of the present invention, an improved shifting tool is provided for selectively engaging a closing sleeve, for example in a sliding side door flow conductor valve and the prop sleeve in a flapper valve. The shifting tool includes multiple keys which are coupled for radial deflection relative to the shifting tool mandrel by compression springs. Each key of the shifting tool have a predetermined profile which permits selective engagement of the keys with the closing sleeve and the prop sleeve.

According to yet another aspect of the invention, a washing tool may be landed in positive, latched engagement with the latch receptacle by a releasable ratch latch assembly.

Operational features and advantages of the invention will be understood by those skilled in the art upon reading the detailed description which follows with reference to the attached drawings.

DETAILED DESCRIPTION OF THE PREFERRED EMBODIMENTS

Figures 1A, 1B:
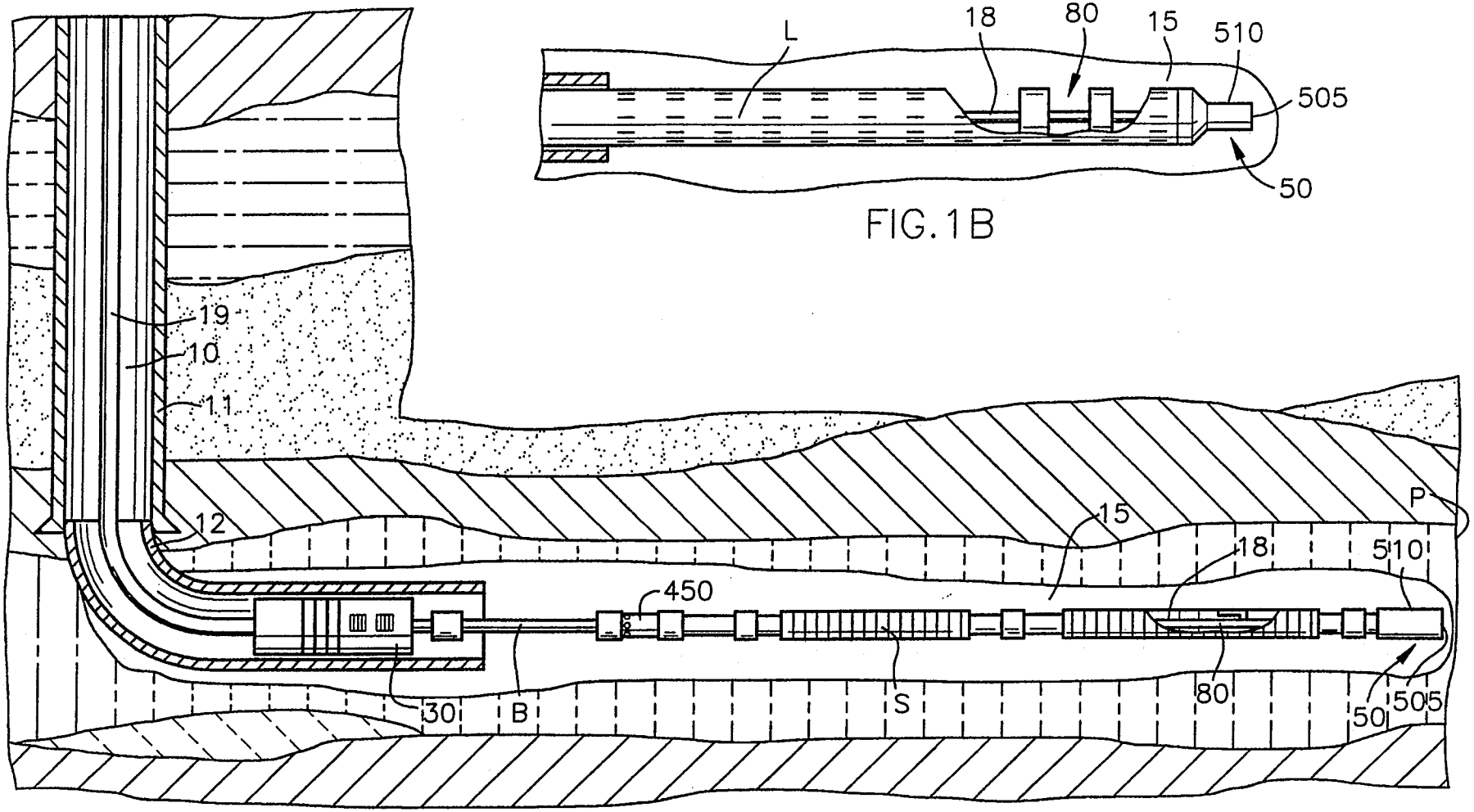
FIG. 1A is schematic view of a horizontal well completion partially in section and partly in elevational, illustrating the relative positions of the principal completion components of the present invention.
FIG. 1B is a schematic view of a portion of a well completion shown in elevation, partially cut away, in which a slotted liner is provided as the downhole filtration device.

In the description which follows, like parts are marked throughout the specification and drawings with the same reference numerals, respectively. The drawings are not necessarily to scale and the proportions of certain parts have been exaggerated to better illustrate details and features of the invention. Furthermore, throughout the specification, the letter "T" has been used to denote threaded tubular connections.

Referring now to FIG. 1A, a bore hole 10 for an earth well is drilled more or less vertically through several layers of overburden and may, through the use of directional drilling motors or the like which may turn from the vertical to a more or less horizontal orientation for the purpose of either placing as much of the bore hole within a producing stratum P, or for reaching an oil producing formation remote from the vertical run of the bore.

The vertical run of the well bore is supported against collapse by a casing 11 which is cemented in position and through which a tubular liner 12 is run. As shown, the liner extends only a portion of the length of the non-vertical run of the well, leaving the balance of the bore as an uncased open hole 15, which may be subject to erosion or collapse after the well is placed on production.

In order to place the well on production, production tubing which incorporates some form of downhole filtration means such as one or more wrapped wire well screens as shown in FIG. 1A or one or more dual concentric wrapped wire well screens prepacked with sand, gravel or epoxy coated gravel, commonly referred to as dual screen prepack well screens, or sintered metal tubes, collectively S, are run in the uncased portion of the well bore to limit the flow of sand fines into the production tubing along with the produced formation fluids. For purposes of this specification, wrapped wire well screens, dual screen prepacks and sintered tubes will collectively be referred to as well screens. Alternatively, as shown in FIG. 1B, a slotted liner, L, may be utilized in place of or in addition to well screens.

According to the present invention, an hydraulically actuated packer 30 having retrievable hydraulic setting tool 20 shearably attached thereto is located within liner 12 and a sufficient number of lengths of blank pipe B are placed in the production string and threadedly attached to the hydraulic packer to permit proper placement of the downhole filtration apparatus relative to the producing formation P. The packer 30 is hydraulically connected to the earth's surface through a tubular work string 18.

In a substantially horizontal well bore, the open bore hole 15 is frequently littered with drill cuttings, not shown, which make proper placement of the filtration means difficult. According to the current invention, a float shoe 50, described in further detail below, is attached to the end of the downhole filtration device. The float shoe has a longitudinal flow passage therethrough with a lower flow port 505 at one end and a plurality of lateral flow ports 510 extending from the longitudinal flow passage through the external surface of the float shoe. The longitudinal flow passage of the float shoe is connected in flow communication with the work string 18 which is concentrically placed within the flow passage of the downhole filtration device and run concurrently therewith.

In this manner, fluid may be pumped down the work string 18 under pressure and through flow ports 505 and 510 in the float shoe 50 to jet wash the drill cuttings and other debris away from the filtration device, thereby facilitating the easy placement of sand screens in the desired location within the well bore.

A ported cup packer 80 is shown incorporated in work string 18 in the cut away portion of screen S and of slotted liner.

Referring now to FIGS. 2A through 2F, the work string, including the float shoe, is shown in the run-in position. It is to be understood that the work string is placed within the bore of production tubing 19 so that the float shoe 50 is secured either to the screen S or the slotted liner L and the work string is run into the hole concurrently with the production tubing.

The hydraulic packer 30 is attached to hydraulic setting tool 20 by lugs 303 and shear screws 242. The setting tool 20 and hydraulic packer 30 are preferably constructed as disclosed in U.S. Pat. No. 4,832,129, which is incorporated herein by reference. The setting tool 20 has piston 210 guided for longitudinal movement in cylinder 212 as a result of being restrained against inner tool mandrel 215 by a cylinder wall 217 and is maintained in sliding engagement therewith. The piston 210 is sealed against leakage of pressurized hydraulic fluid by seal means **218*a* and 218*b* mounted in grooves about the piston head 220. Seal means 222*a* and 222*b* are mounted in grooves about the piston rod 224. The piston rod 224 has a radially inwardly sloping shoulder 226 which cooperates with inner tool mandrel 215 to form a preopening chamber 228 in the cylinder 212. The preopening chamber is connected by a flow port 230 to a longitudinal tool string flow passage 232. The piston rod 224 is in contacting engagement with a packer setting arm 236, which is slidably mounted within a setting arm extension guide 238 and an inner tool mandrel 215. The packer setting arm is restrained from longitudinal movement during run-in by transit shear screws 240. Such restraint is necessary during run-in because it is possible to inadvertently set a packer intended for hydraulic operation if sufficient opposing mechanical forces are generated in the tubing string during run-in, especially as the tubing string is being forced through a turn or bend in the bore hole such as is illustrated in FIG. 1. Additional restraint against premature setting is provided by an anti-preset lug 301 which is incorporated in packer 30**.

Figure 2A:
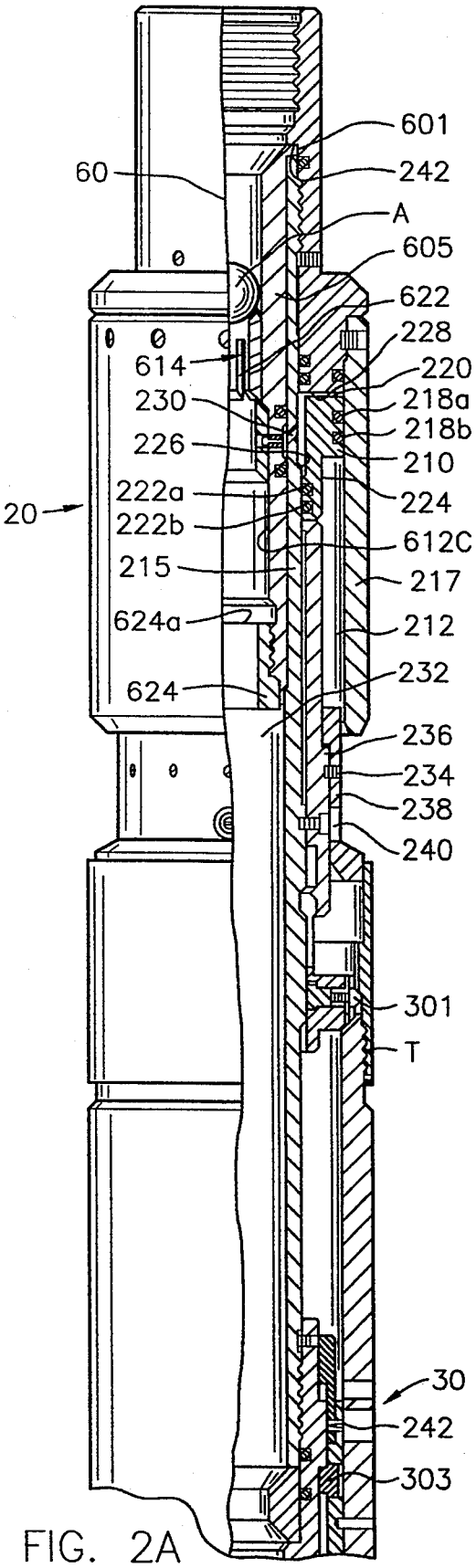
FIGS. 2A through 2I taken together is a view, partly in section and partly in elevation of the isolation work string constructed according to the present invention as it is run in the hole.
Figure 9:
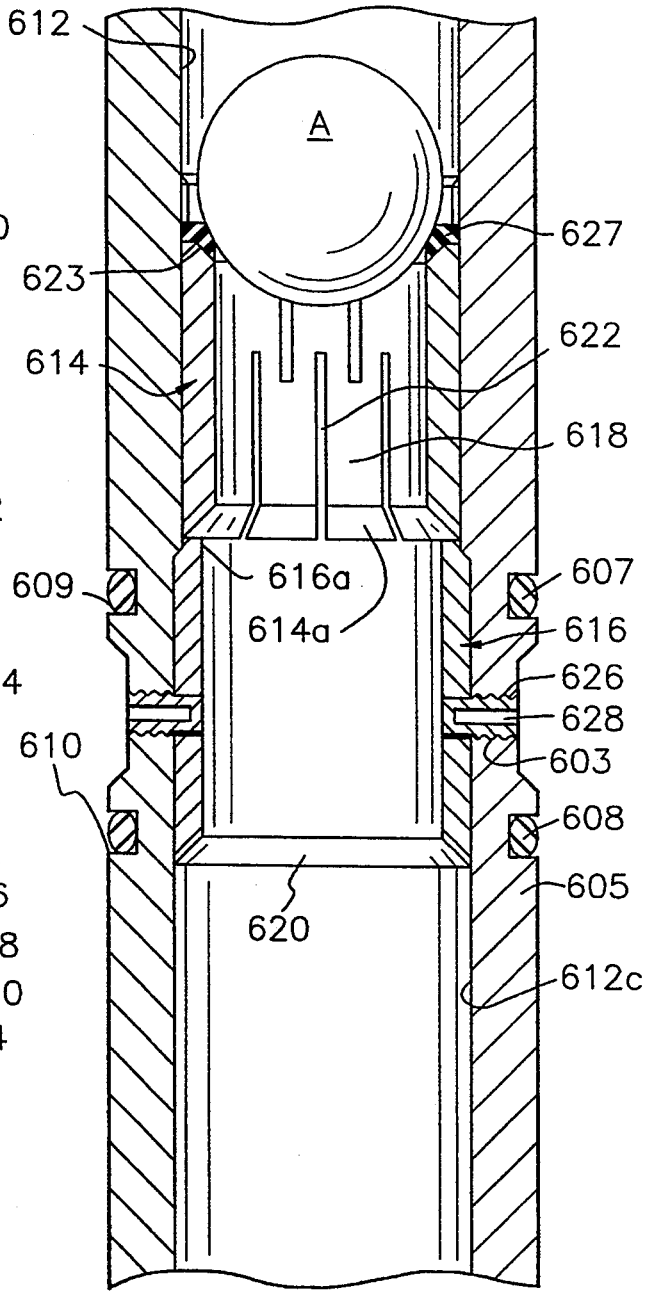
FIG. 9 is a longitudinal half sectional view of an expendable plug and drop ball assembly.

Referring now to FIG. 2A and FIG. 9, an expendable plug assembly 60 is slidably fitted into the tool string flow passage 232 and is supported therein by the cooperation of an outwardly turned shoulder 601 of an external mounting collar 605 with upper shoulder 242 of the inner tool mandrel 215. The plug assembly is aligned within the tool string flow mandrel 232 so that a radially extending flow bore 603 in the plug assembly is in flow alignment with the flow port 230 of the hydraulic setting tool 20.

The expendable plug assembly 60 includes a cylindrical external mounting collar 605 having at least one internally threaded radially extending flow bore 603 extending from the outside of the cylinder to the inside of the cylinder. Intermediate the flow bores and the ends of the mounting collar are sealing means, such as o-rings 607, 608 fitted into grooves 609, 610 to prevent leakage into the radially extending flow bore 603 from around the ends of the external mounting collar 605.

Compressed within longitudinal bore 612 of external mounting collar 605 is an internal C-ring 614 which is intersected longitudinally by a plurality of slots 622 which are cut into the sleeve, thereby defining circumferentially separated segments 618. The internal C-ring 614 engages a shear sleeve 616. The C-ring 614 has multiple longitudinal slots 622 forming a dividing junction between adjacent segments. The shear sleeve and the segments combine to form a generally cylindrical shape when the ring and the segments are compressed until the adjacent sides of the segments are touching each other.

The C-ring has a radially inwardly sloped shoulder 623 which is coated with a polymeric coating 627, such as nitrile rubber, to form a seat for a drop ball A. The polymeric coating also assists in the maintenance of the outwardly biased ring collar in its circular shape. The lower end of the C-ring 614 has a beveled face 614A which mates with offset beveled face 616A on the shear sleeve 616.

The shear sleeve 616 is radially intersected by bore holes 624 corresponding and alignable with the internally threaded, radially extending flow bores 603 in the external mounting collar 605. Shearable means such as hollow shear screws 626 are threadedly engaged in the radially extending flow bores 603 in the external mounting collar 605 and extend into bore holes 624 sufficiently far enough that at least a portion of the hollow center 628 and its blind end 629 extend into the flow bore.

A releasable seat is provided for the drop ball A by the outwardly biased split C-ring 614. The C-ring is received within the flow bore 612 of the guide collar 605. Longitudinal displacement of the C-ring is blocked by the shear sleeve 616. The shear sleeve is received within a smooth counterbore 612 which intersects the mounting collar 605. The shear sleeve 616 is pinned to the mounting collar 605 by the hollow shear screws 626. The entrance to the setting port 230 is sealed by the annular O-ring seals 607, 608 so that the hydraulic expansion chamber of the packer is sealed with respect to the flow bore during run in. The O-ring seals are longitudinally spaced in slidable, sealing engagement between the isolation sleeve and the smooth bore of the guide tube. The O-ring seals thus seal the flow bore with respect to the packer hydraulic pressure chamber when the shear sleeve is in the covered (RUN) position as shown in FIG. 2A.

When it is desired to set the packer, the drop ball A is released and flowed into sealing engagement with the C-ring seat. The hydraulic pressure is increased until the hollow shear screws 626 separate, thus opening the setting port and permitting the shear sleeve to be shifted along the smooth bore of the guide tube to the uncovered position as shown in FIG. 3A and in FIG. 4A.

As the C-ring 614 and shear sleeve 616 shift longitudinally through the flow bore, the C-ring 614 moves into the counterbore 612, thus radially expanding and releasing the drop ball A. The drop ball A is then flowed into the ball catcher 315 as shown in FIG. 3B. After the setting port has been opened, hydraulic fluid is pumped into the pressure chamber, thus causing the setting piston to be driven longitudinally along the setting tool mandrel for applying a setting force against the packer sealing elements and anchor slips. After the seal elements and anchor slips have been set, the drop ball A will remain on the ball catcher sub 315 until the hydraulic pressure is increased, releasing the drop ball A as discussed below.

Returning now to FIG. 2A, the hydraulic packer 30 includes inner tool mandrel 215 which extends through the longitudinal bores of both the hydraulic setting tool 20 and the packer 30, and an element mandrel 302 which supports sealing element package 305, including three sets of elements, 305*a*, 305*b* and 305*c* which are constructed from conventional materials which are chosen to be compatible with the downhole environment in which they are intended to function, and opposing slips 310*a* and 310*b*.

Figure 3A:
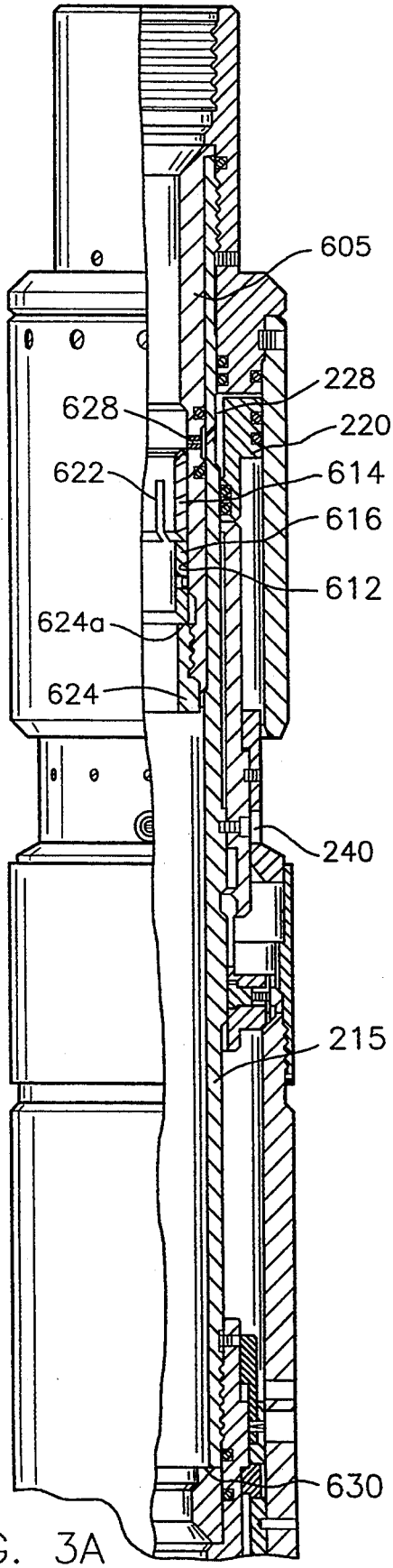
FIGS. 3A and 3B taken together is a view partly in section and partly in elevation of a hydraulic packer, hydraulic setting tool and expendable plug constructed according to one aspect of the present invention, showing the setting ports of the setting tool have been opened but before the packer is set.
Figure 3B:
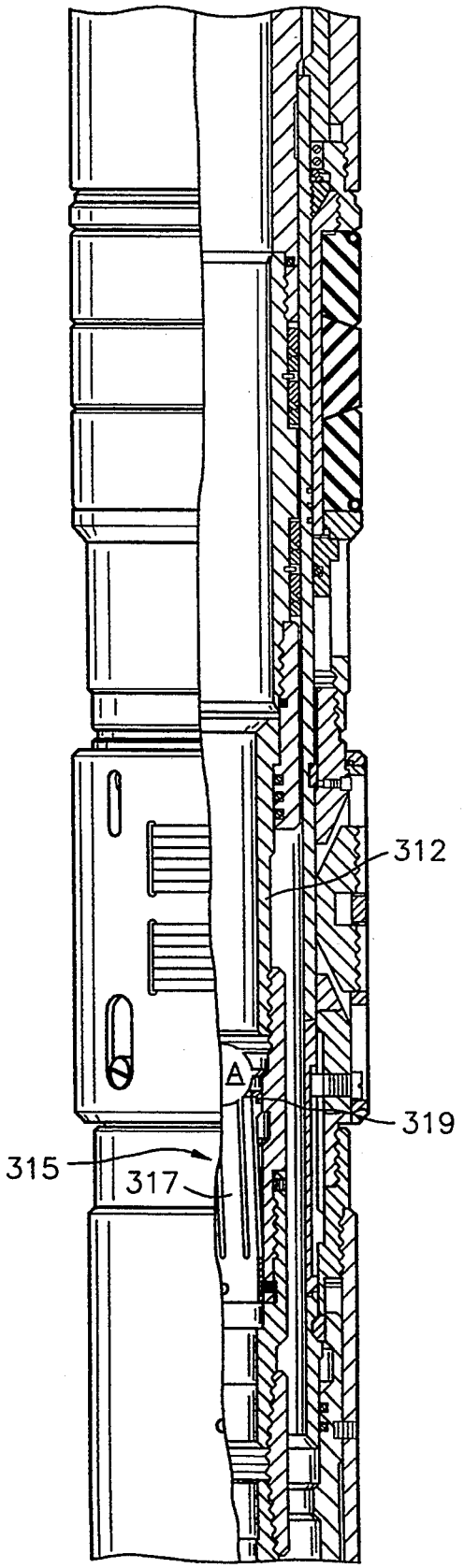

Referring to FIGS. 3A, 3B, the inner tool mandrel 215 is threadedly connected to production tubing 19 at its upper end and to a swivel joint 312 to allow rotation of a washpipe 401, described below, at its lower end. Threadedly connected to the swivel joint is a collet type ball catcher 315 of conventional construction. The ball catcher 315 includes a plurality of resilient collet fingers 317 and an upper sealing shoulder 319 with which the collet fingers cooperate to form a ball seat. The drop ball A is pumped into sealing engagement with the ball seat 319 to provide a means to increase pressure within tool string flow passage 232.

Referring to FIG. 3A and FIG. 9, in order to set the packer 30, the drop ball A is pumped down work string 18 into sealing engagement with the elastomeric seat 627 of an internal C-ring ball seat 614. The C-ring ball seat 614 is intersected by longitudinal slots 622 to provide flexibility and is biased for outward radial expansion. The ball seat 614 is landed on an annular shoulder 616A of the shear ring 616, and is slidably received within the flow bore 612 of a guide collar 605. The shear ring 616 is slidably received within a counterbore 612C of the guide collar 605, and is releasably secured by hollow shear screws 626.

Increasing the hydraulic pressure in the work string forces the C-ring ball seat 614 downwardly into engagement with the shear ring 616 which engages the hollow shear screws 626 causing the screws to shear, thereby opening the hollow pocket 628 and creating a flow passage between the tool string flow passage 232 and the preopening chamber 228. Further increasing pressure in the work string causes the internal C-ring seat 614 to be expelled from the external guide collar 605.

As is shown in FIG. 3A, after the C-ring ball seat 614 clears the external guide collar, the outwardly biased C-ring ball seat 614 expands radially into contact with the counterbore inner wall of the guide 605, thereby releasing the ball. The increased pressure forces the C-ring ball seat 614 through the counterbore 612C into engagement with a shoulder 624A of an end cap 624. The drop ball A moves down the inner mandrel until it engages a secondary ball seat 315 (FIG. 4B). The ball seat has an elastomeric seat 319 supported on collet fingers 317. This action seals the flow passage above the secondary ball seat 315 and allows transfer of pressurized hydraulic fluid to the preopening chamber 228 through the setting port 230.

Figure 4A:
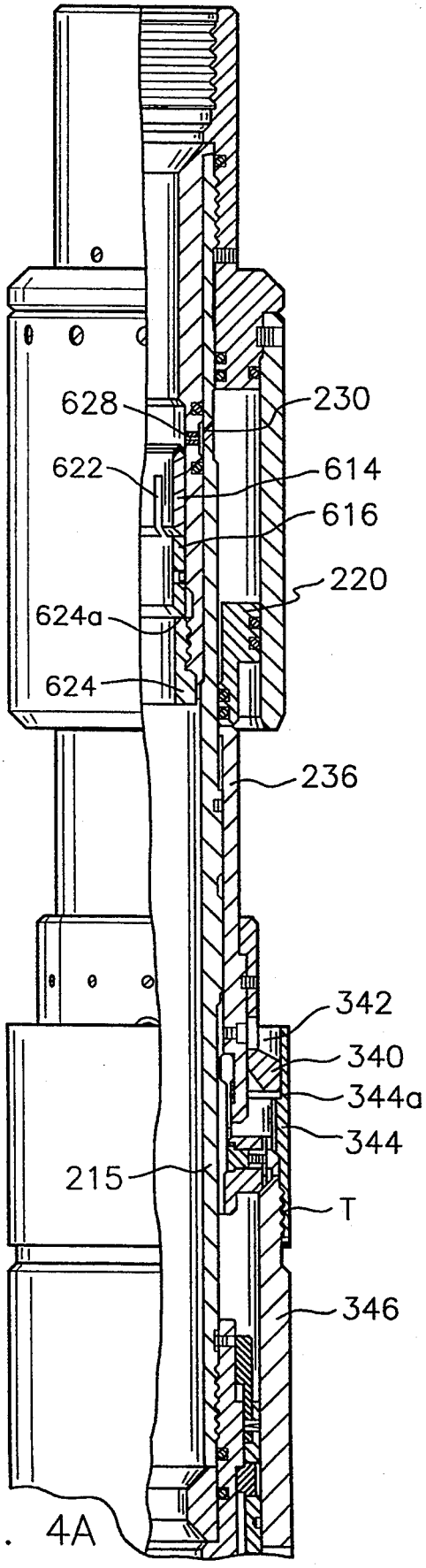
Figure 4B:
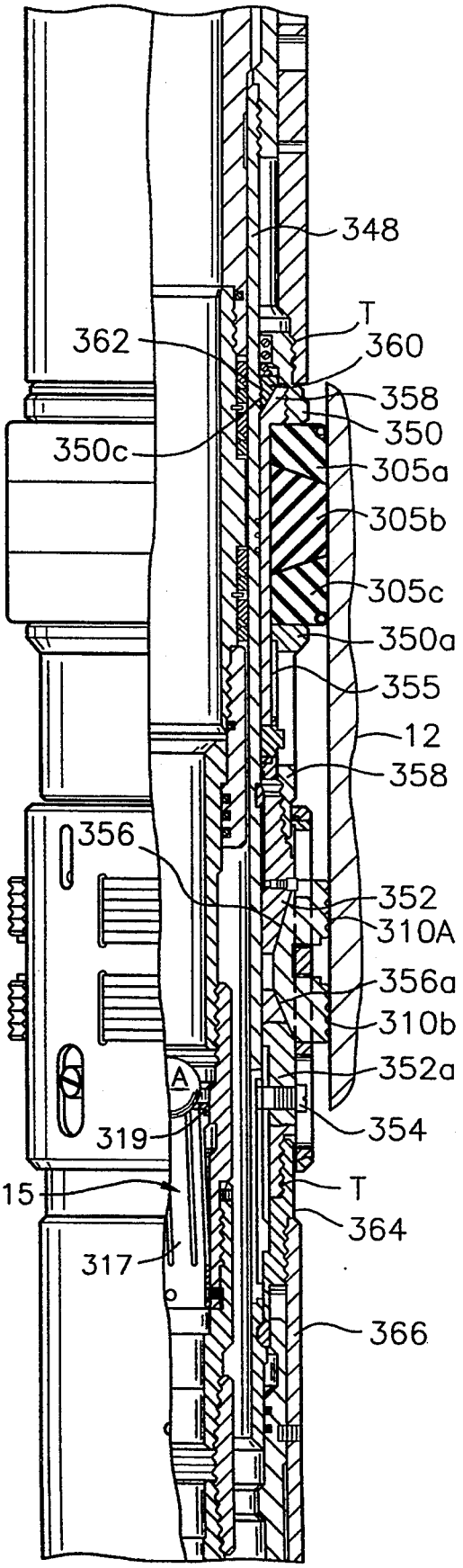

Referring now to FIGS. 4A and 4B, once the drop ball A is landed on the resilient collet fingers 317 of the collet catcher 315 and comes into sealing engagement with sealing shoulder 319, fluid pressure is directed through the setting port 230 into the preopening chamber 228. As hydraulic pressure is applied to the piston 220, the hydraulic force shears the transit shear screw 240 thus permitting the piston 220 to longitudinally displace the packer setting arm 236 and the setting arm extension guide 238.

The setting arm extension guide 238 has wedge 340 coupled to its lower end and slidably restrained within a channel 342 formed by the lower end of the packer setting arm 236 and the tube extension guide 344. The tube guide extension 344 is threadedly connected to the tube guide 346 at a threaded union T and has radially inwardly stepped shoulder 344*a* which engages wedge 340 as the wedge is longitudinally displaced responsive to the longitudinal displacement of the packer setting arm 236. The tube guide 346, which is free to move longitudinally with respect to inner packer mandrel 348, is threadedly connected to the upper element retainer 350 by a threaded union T.

The tube guide 346 is free to move with respect to the inner packer mandrel 348. Additionally, the upper element retainer 350, element package 305, comprising three elements 305*a*, 305*b*, and 305*c*, lower element retainer 350*a*, upper wedge 352, opposing slips 310*a* and 310*b* and lower wedge 352*a*, are also free to move with respect to inner packer mandrel 348. However, downward motion of the packer components in response to longitudinal motion of packer setting arm 236 is transferred to the wedge by element retainer 350 through elements 305*a*, 305*b* and 305*c*.

Such motion is translated upwardly thereby forcing opposing angular camming surfaces 356 and 356*a* of upper wedge 352 and lower wedge 352*a*, respectively, against mating camming surfaces on opposing slips 310*a* and 310*b*. This causes the anchor slips to be forced into engagement with the inner wall of the liner 12. Once the slips are set against the liner, further motion of the slip carriers is blocked and the applied force is then transmitted to the lower element retainer 350*a* through the lower element retainer extension 358 thereby opposing the downward force exerted by packer setting arm 236 against the upper element retainer 350. These opposing forces compress element package 305 thereby forcing the seal elements 305*a*, 305*b* and 305*c* into sealing engagement with inner wall of liner 12.

The upper element retainer extension 358 has an internal angular camming surface 350*c* which mates with a corresponding camming surface on a triangularly shaped internal slip 360. The base of the slip has a serrated surface 362 which is forced into biting engagement with a roughened surface on the inner packer mandrel, commonly called a "phonograph" finish, in response to inward forces generated by the camming engagement of the camming surfaces of upper element retainer 350 and internal slip 360. Biting engagement of element locking block prevents the undesired unsetting or decompression of the element package 305 and of opposing slips 310*a* and 310*b* from engagement with liner 12.

The lower wedge 352*a* is threadedly connected at union T to a pin connector 364 which is in turn threadedly connected to lower packer body 366.

Referring now to FIGS. 2C through 2I, the lower packer body is threadedly connected at threaded union T to a lower box connector 368 into which the threaded pin of blank pipe B is received.

Referring again to FIG. 2C, the tubular sleeve valve 450, having upper box connector 451 threadedly connected to blank pipe B at threaded union T, includes an external tubular member 452 having a longitudinal flow bore 453 therethrough and connecting the upper box connector 451 and the lower box connector 464. Intermediate the box connectors, a plurality of flow ports 454 connect flow bore 453 with the exterior of the sleeve valve. The tubular sleeve 456 is received within the flow bore 453 and adapted for reciprocal motion from a first open position wherein the longitudinal flow bore is in flow registration with the exterior of the sleeve valve to a second closed position wherein the flow registration is prevented by the positioning of the sleeve across the flow ports.

Reciprocal motion is restricted between upper restraining shoulder 462*a* and lower restraining shoulder 462*b* in the second closed position. A plurality of O-ring seals 458*a*, 458*b*, 458*c* and 458*d* are mounted about the exterior of the tubular sleeve intermediate the ports and the ends of the sleeve valve to prevent leakage around the sleeve. A detent 460 is formed between raised shoulders 460*a* and 460*b* which are formed on the interior wall of the tubular sleeve.

In one embodiment of this invention, one or more lengths of blank pipe B are threadedly joined to each other in series by threaded unions T, the uppermost of the pipes being threadedly connected to lower box connector 464 and the lowermost of the pipes being threadedly connected to one or more well screens S also connected in series to each other. A sufficient number of lengths of blank pipe are also provided to position the well screen appropriately within the producing stratum P and a sufficient number of lengths of well screen S are provided to traverse the producing stratum.

In an alternative embodiment as shown in FIG. 1B, a slotted liner L may be substituted for the lengths of blank pipe and well screen described above or positioned concentrically around the well screen and run concurrently therewith.

A washpipe 401 is concentrically disposed within the blank pipe B and the well screens or within the slotted liner, and projects through the mandrel of the hydraulic packer 30.

Figure 2B:
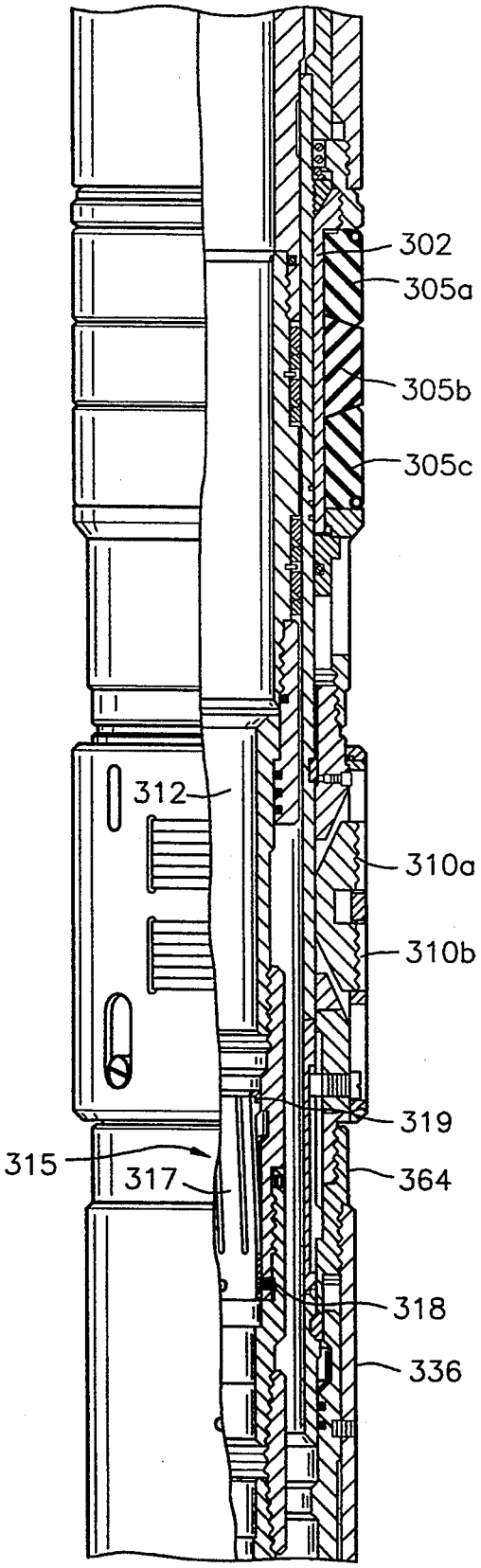
Figure 2C:
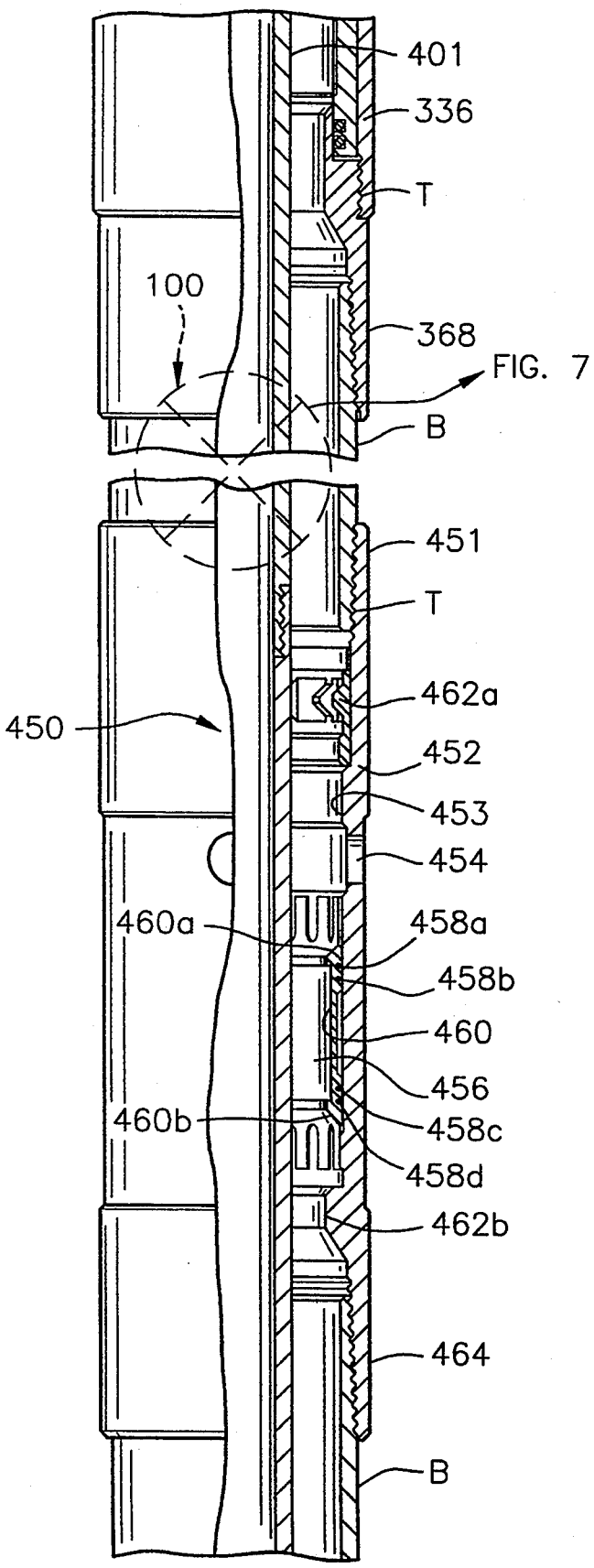
Figure 2D:
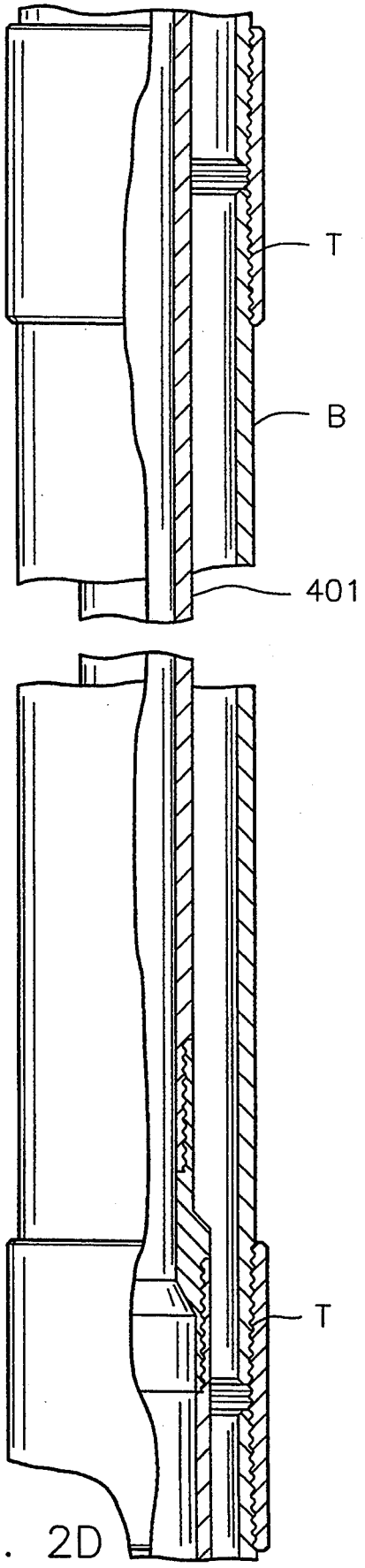
Figure 2E:
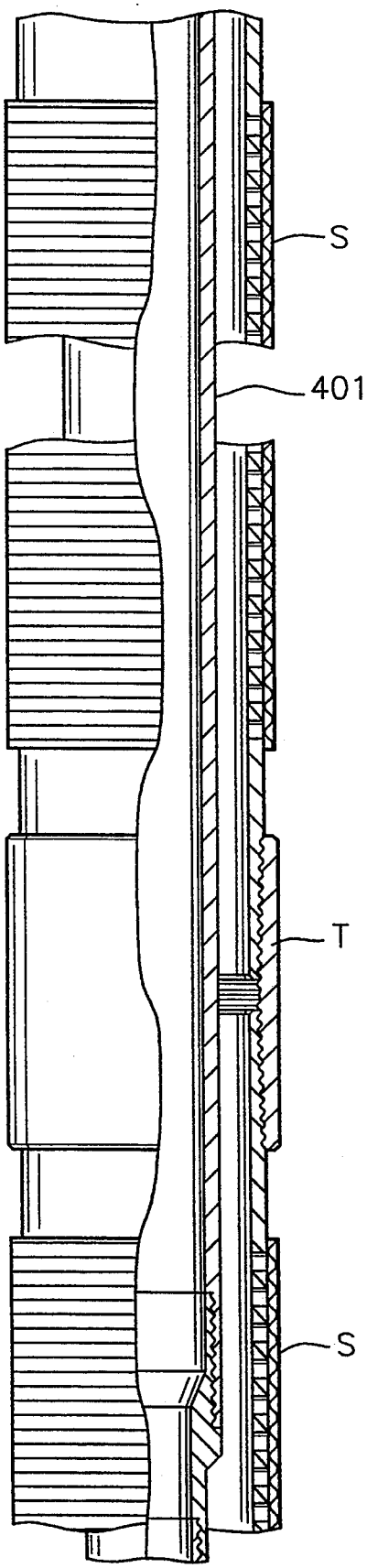
Figure 2F:
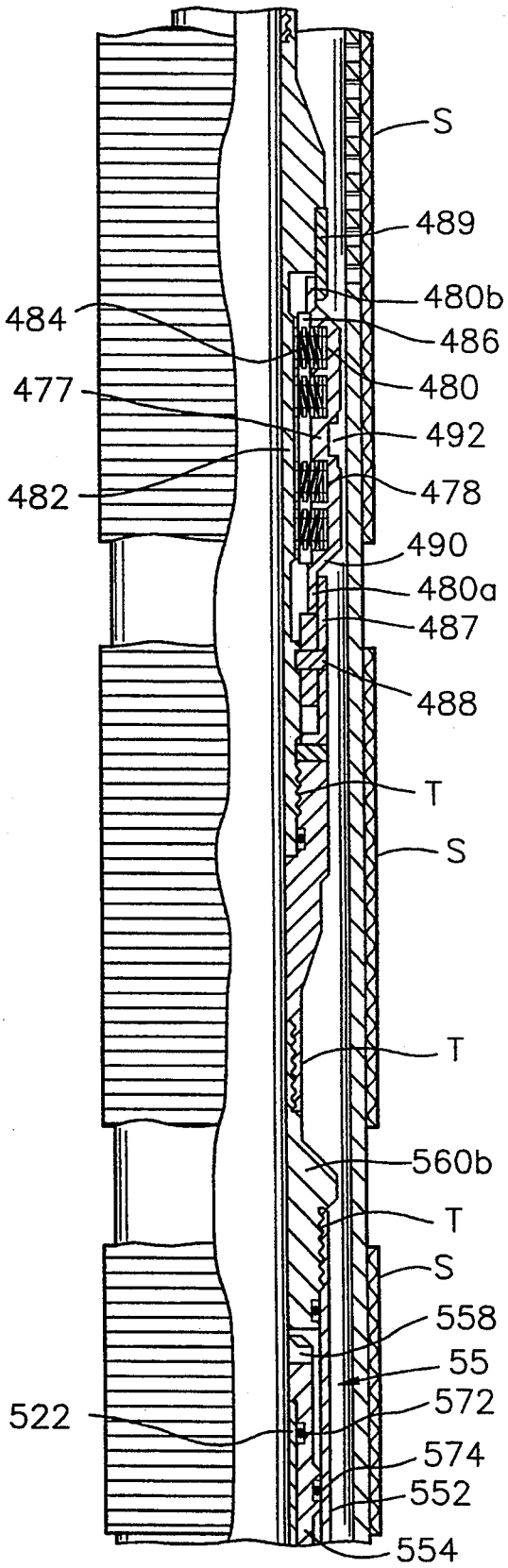

Referring now to FIG. 2F, a shifting tool 476 is connected between the washpipe and the travel joint assembly 710. The shifting tool 476 includes a key plate segment 477 having multiple key projections 478, 480. The key plate 477 is resiliently coupled for radial deflection relative to the shifting tool mandrel 482 by coiled compression springs 484. Each key of the shifting tool has a predetermined profile and longitudinal separation with respect to adjacent keys which permits selective engagement of the tool with the closing sleeve 456 (FIG. 2C) and with the prop sleeve (FIG. 7) thereby enabling the key profile portion to selectively engage a detent 460 on sleeve 456 of the sleeve valve 450.

The end portions 480*a*, 480*b* of the keys are received within an annular, longitudinal slot 486 formed in the shifting tool mandrel 482, wherein the slot 486 defines a deflection chamber Radial deflection of the plate end portions is limited in the radial outward direction by retainer rings 487, 489. The shifting tool assembly also includes a set of shear pins 488 which permits emergency release of the shifting tool if it should become stuck. Emergency release of the shifting tool is carried out by continually to overpull through the service string, shearing the shear pins 488, with the ramp surface 490 of the keys engaging the bottom sub to cause radially inwardly deflection movement of the keys to permit the shifting tool to be retrieved.

Upward motion of the work string 18 and shifting tool after its keys are so engaged shifts the tubular sleeve 456 of the sleeve valve 450 from the open position to the closed position. Alternatively, the tubular sleeve could be arranged to shift upon downward motion of the work string.

Referring to FIG. 2F, threadedly attached to the washpipe below the shifting tool at threaded union T is an outer tube 552 of telescoping travel joint 55. Concentrically disposed and slidably mounted about the inner expansion tube 522 is an outer expansion tube 552. A torque clutch 558 and a torque clutch 560 are threadedly attached to the opposing end of the outer tube. Each torque clutch has milled fingers for releasable interlocking engagement in the expanded and retracted positions. On run-in, the inner travel tube 522 is maintained in a fully retracted relationship with respect to the outer tube 552 by a travel joint lock assembly 712 as shown in FIG. 2G.

Figure 2G:
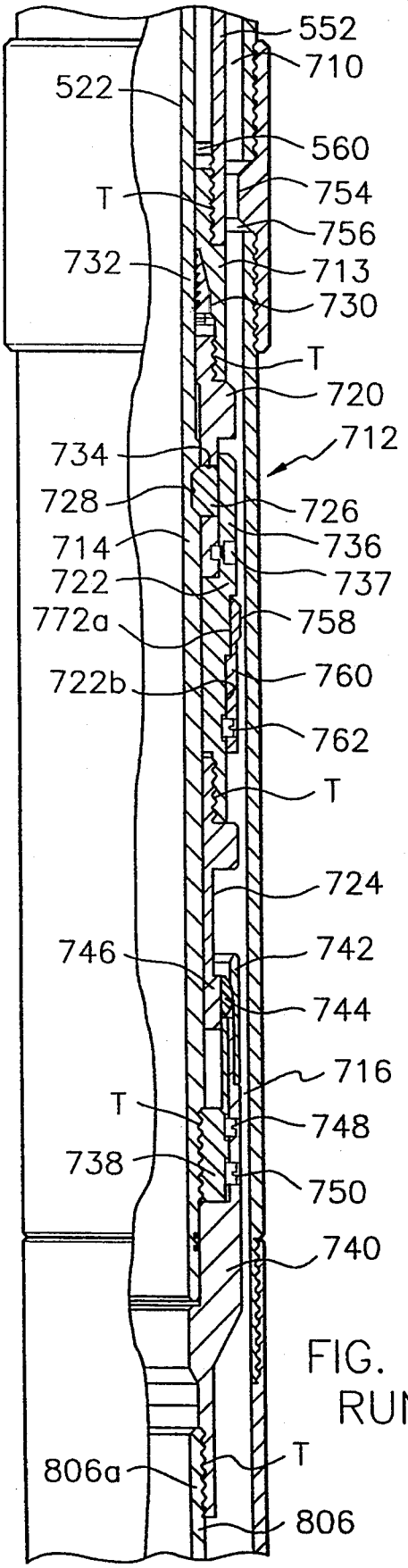
Figure 2H:
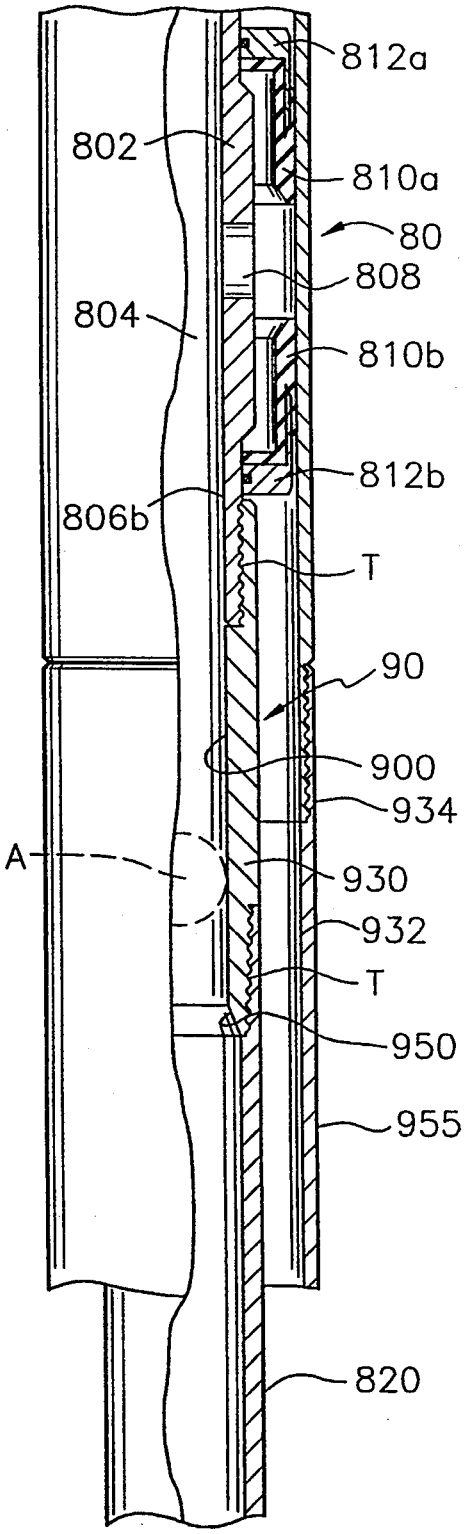

Referring now to FIG. 2G and FIG. 2H, the cup packer 80 includes a tubular mandrel 802 having longitudinal flow bore 804 therethrough and terminating in upper and lower pin connectors 806*a*, 806*b*, respectively. Intermediate the pin connectors are a plurality of flow ports 808 which connect the longitudinal flow bore with the exterior of the cup packer. Intermediate the flow ports 808 and the pin connectors 806*a*, 806*b* opposing bowl-shaped sealing means 810*a*, 810*b* are fixedly and supportedly attached to the exterior of the tubular mandrel. The sealing means 810*a*, 810*b* are supported on the mandrel in sliding and sealing engagement with the interior wall of the production tubing 19 by L-shaped sealing support means 812*a*, 812*b* respectively. The sealing means 810*a*, 810*b* are constructed of resilient elastomeric material, such as nitrile rubber. Formed within the longitudinal flow bore 804 adjacent to the lower pin connector 806*b* is the lower ball catcher sub 90, which is disposed to receive the drop ball A in sealing engagement therewith and for trapping the drop ball against expulsion due to gravity to the ball.

The drop ball A must be carefully chosen not only for selection of the proper diameter, but also for appropriate ductility since the ball must extrude upon the application of pressure. Therefore, drop balls made of metals with a hardness greater than 80 Rockwell B, such as steel, are not suitable for the application described below because they will not extrude into the sloping bore upon application of pressure from above. Better suited to this purpose is a drop ball made from materials having a durometer hardness ranging from about 50 Shore D to 75 Shore D. Such materials include soft metals such as brass and lead, elastomers such as urethanes, polyalkylene oxide polymers, silicone, fluorosilicone, polysulfide, polyacrylate, hypalon, Nylon 6 loaded with molybdenum sulfide, teflon, glass-filled teflon, nylon and glass-filled nylon. Also, rubbers, such as natural rubber, isoprene rubber, butadiene rubber, styrene-butadiene rubber, isobutene-isoprene rubber, chloroprene rubber, nitrile butadiene rubber and fluororubber may be utilized in place of the elastomers. Especially suited for this application is a drop ball manufactured from glass-filled nylon.

Referring to FIG. 2H, the dimensions of the tapered seat 900 are critical because it is desirable that drop ball A wedge into the tapered bore as a result of the application of pressure from above. Accordingly, it is desirable that the slope of the tapered bore 900 be such that a portion of the ball material is wedged within the tapered bore. This will provide an adequate seal under horizontal completion conditions.

Figure 10:
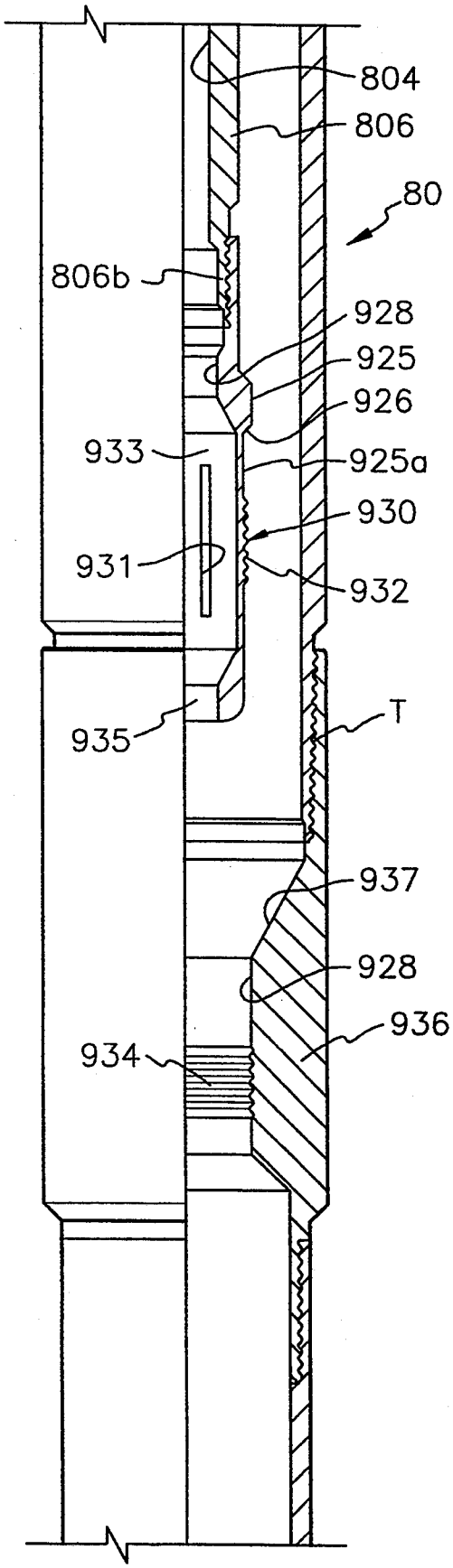
FIG. 10 is a longitudinal quarter sectional view of a washpipe latch assembly in the unlatched position.
Figure 11:
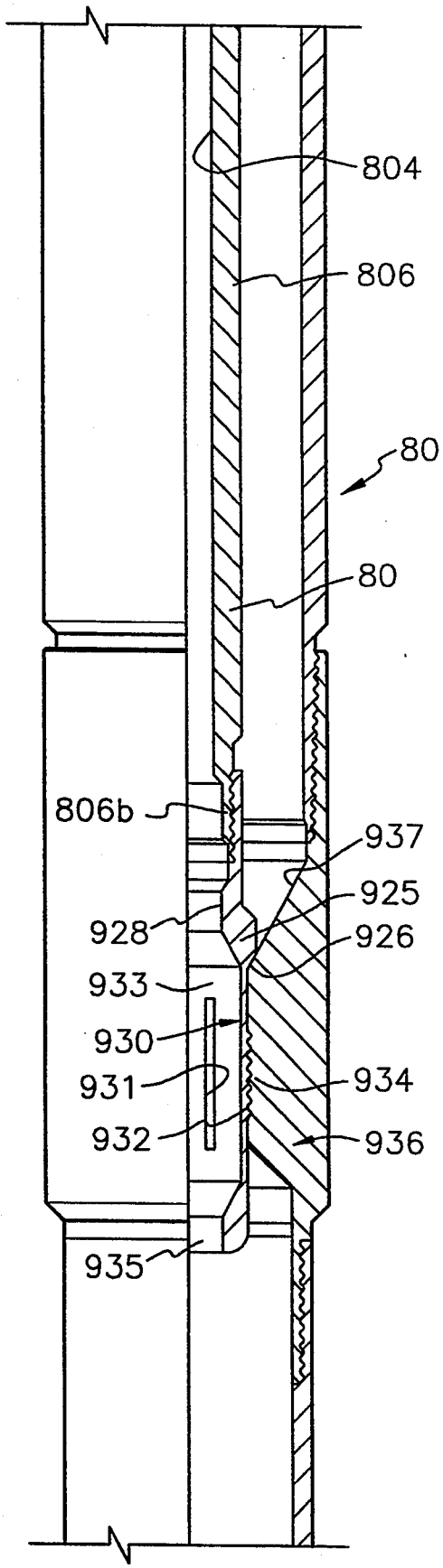
FIG. 11 is a view similar to FIG. 10 showing the latch positively engaged and sealed in a latch receptacle.

Referring now to FIG. 10 and FIG. 11, threadedly attached to the lower pin connector **806*b* at threaded union T is latch mandrel 925 in which the longitudinal flow bore 928, which extends the length of the latch mandrel, is in flow registration with longitudinal flow bore 804 of cup packer 80, and opens into the discharge flow port 935. The latch mandrel has a thin sidewall 925A which carries a tubular ratch latch 930 having a plurality of axially aligned elongated collet fingers 933 which are spaced by elongated slots 931. The helical threads 932 extend around the outer circumference of the collet fingers 933. The helical threads 932 may be formed over a relatively long section over the outside of fingers 933 so that repeatable latching engagement may be obtained without precisely locating the ratch latch at a specific point. The helical threads 932 are engageable with corresponding helical threads 934 of a latch receptacle 936, as shown in FIG. 10 and FIG. 11. Preferably, the helical threads 934** have a 90° upwardly facing shoulder and a 45° downwardly sloping shoulder.

The latch assembly is positively engaged by downward longitudinal movement of the work string from the position in FIG. 10 to the position shown in FIG. 11. Advancement of the latch mandrel 925 relative to the seal receptacle 936 is limited by engagement of a radially projecting shoulder portion 926 against the latch receptacle mandrel shoulder 937. As latch mandrel 925 is forced downward into seal receptacle 936, fingers 933 spring inward, allowing threads 932 to ratchet across the latch threads 934. As may be appreciated, the threads 932 and 934 are arranged so that the threads 932 may move downward across threads 934 while preventing upward ratching movement of threads 932 across threads 934.

The thin sidewall 925A of the latch mandrel is intersected by longitudinal slots 931, thereby defining multiple deflection segments 933. According to this arrangement, the latch 930 may be stabbed into the latch receptacle 936, with the segments deflecting radially inwardly and the helical threads 932 ratcheting across the helical threads 934 until the latch mandrel shoulder 926 engages the latch receptacle shoulder 937, as shown in FIG. 11.

The washpipe is not permitted to move relative to the latch receptacle 936 because of the high frictional engagement of the threaded union. The washpipe assembly may be released by pulling up on the work string 19 until the shear pins 748 separate. The ratch latch assembly 925 and cup packer assembly 80 will typically be "parked" in the screen S and blank B assembly after the washpipe is removed. The washpipe assembly above that point is retrieved while the ratch latch and cup packer remain parked. This is normally necessary due to bore size restrictions above the cup packer assembly. The cup packer and latch assemblies may then be released by applying right hand rotation to disengage the threads, and applying a straight upward pull. This would only be done to re-wash the screens since the bore restriction should still exist.

Figure 2I:
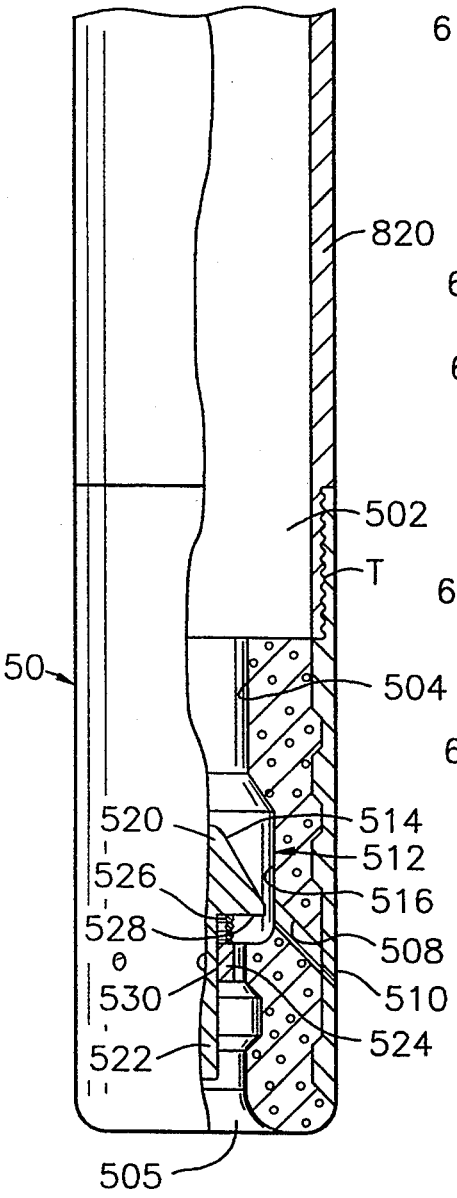

Referring now to FIG. 2I, the float shoe 50 is threadedly attached to a tubular flow conductor 820 by a threaded union T. A longitudinal flow bore 504 extends the length of the float shoe and opens into the lower discharge port 505 as previously described. Formed within the longitudinal flow bore is a check valve 512. The check valve 512 has upper conical valve seat 514 formed as a radially outwardly sloping shoulder in the flow bore 504 and a valve housing section comprising a cylindrical bore 516. The valve housing section has a plurality of radially extending flow passages 508 which terminate in laterally extending flow ports 510.

The check valve 512 has an upper conical valve portion 520 with cylindrical valve stem 522 depending therefrom, the valve stem being slidably mounted within valve stem guide 524. The conical valve is biased to the closed position by a spring 526 which is wound around the valve stem and confined between a lower flat face 528 of conical valve portion 520 and the valve stem guide 524. When the conical valve 520 is forced open by pressure from above, the spring 526 is compressed between the lower flat face and the valve guide, with the compressed spring preventing the flat face from bottoming out on lower shoulder 530 of the cylindrical bore 516, thereby maintaining open fluid flow passages through both lower flow port 505 and lateral flow ports 510.

Figure 5:
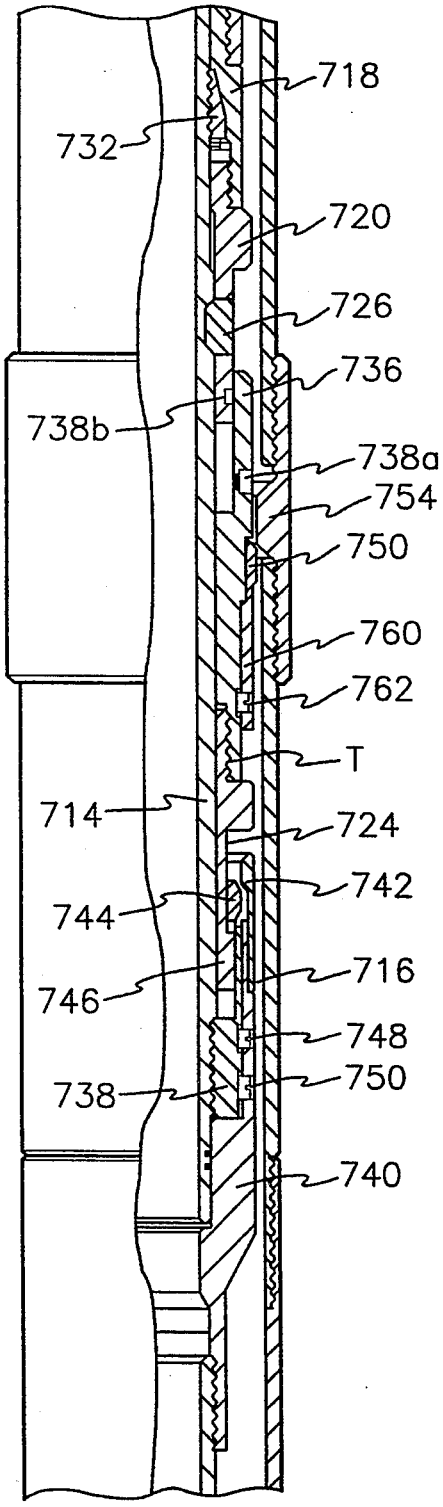
FIG. 5 is a view, partly in section and partly in elevation, of the travel joint and lock apparatus in the release position to permit expansion of the travel joint.
Figure 6:
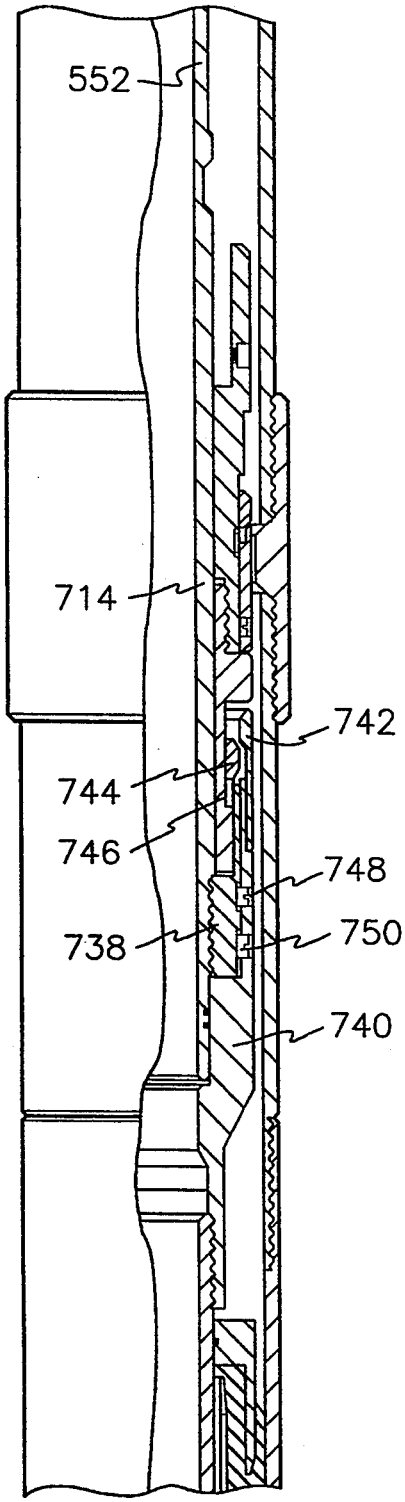
FIG. 6 is similar to FIG. 5 showing the travel joint and lock apparatus positioned for a land and latch operation.

Referring now to FIG. 2G, FIG. 5 and FIG. 6, a travel joint assembly 710 is releasably secured between the service tool and the washpipe/sand control string by a travel joint lock assembly 712. The travel joint lock assembly 712 has a tubular mandrel 714 which is connected on one end to the inner travel joint tube 522, and on its opposite end to a washpipe connector assembly 716. The travel joint lock assembly includes a coupling sleeve 718 which is attached to the outer travel joint tube 552, a tubular extension sleeve 720, a tubular carrier sleeve 722 and a tubular prop sub 724, all mounted for slidable movement along the tubular mandrel 714. The travel joint lock assembly also includes a set of locking lugs 726 which are received in an annular slot 728 which is formed in the travel joint lock mandrel 714.

In this arrangement, the lower end of the shifting tool 476 is connected by a threaded union to the outer expansion tube, which is in turn connected by a threaded union to the coupling sleeve 718. The coupling sleeve 718 is joined by a threaded union T with the tubular extension sleeve 720. The coupling sleeve 718 has a counterbore 730 in which a ratchet slip 732 is received. The tubular extension sleeve is intersected by a radial slot 734 which receives the locking lugs 726. As shown in FIG. 2G, the locking lug 726 is captured in the annular slot 728 and in the radial slot 734 by a tubular extension 736 of the tubular carrier sleeve 722.

The tubular extension sleeve 736 is also releasably secured to the tubular extension sleeve 720 by a set of shear pins 738. According to this arrangement, the inner expansion tube 522 is releasably locked to the outer expansion tube 552 by the set of locking lugs 726 and the shear pins 737. It should be noted that the travel joint lock mandrel 714 is secured by a threaded union T with the washpipe connector 716. The washpipe connector 716 includes an inner release collar 738 and a tubular connector sub 740. The tubular connector sub 740 includes a tubular housing extension 742 in which a C-ring 744 is captured.

The C-ring 744 is supported against inward radial deflection by a tubular prop 746 which is formed on the end of the tubular prop sub 724. The inner release collar 738 is releasably secured to the tubular connector 740 by a shear pin 748 and a antirotation lug 750. The antirotation lug 750 is received in a longitudinal slot 752 which permits longitudinal separation of the release coupling sleeve 738 from the tubular connector sub 740 upon separation of the shear pin 748.

The travel joint lock assembly 712 is released by shearing the shear pin 738 and uncovering the locking lugs 728. This is carried out by applying tension through the work string, the shifting tool and the outer tubular member 552 of the travel joint. The service tool is pulled upward to engage a locator ring 754 which is mounted on the lower flow sub and which has a radially inwardly projecting no-go shoulder 756. The service tool is pulled upwardly until a positive indicator shear ring 758 engages against the shoulder 756, as shown in FIG. 5. The positive indicator shear ring 758 rides on a radially stepped diameter portion 722*a* of the carrier sleeve and is propped against longitudinal displacement by a shear sleeve 760. The shear sleeve 760 is secured by shear pin 762 to a radially diameter portion 722*b* of the carrier sleeve 722.

Once the sand control operation has been completed, the service tool is pulled upward to cause the positive indicator shear ring to engage against the locator ring 754, as shown in FIG. 5. As the tension is increased, the shear pins 737 are separated, thus permitting longitudinal movement of the carrier sleeve 722 relative to the tubular extension sleeve 720. As a result, the locking lug 726 becomes uncovered, as shown in FIG. 5, thus permitting the locking lug to deflect radially out of the annular slot 728. At the same time, the tubular prop 746 is displaced longitudinally away from its propped position as shown in FIG. 2G to its unpropped position as shown in FIG. 5.

As a result of releasing the locking lugs, the travel joint may be expanded to its stroke limit, whereupon the clutch members 554, 560 are engaged for the purpose of transmitting torque.

The separation shear strength of the shear pins 762 exceeds the separation shear strength of the shear pins 737. Consequently, the shear pins 737 are the first to separate, so that unlocking can be accomplished. The locking components thus remain in the position shown in FIG. 5 until such time as the separation shear strength of the shear pin 762 is exceeded. Prior to that time, however, the expansion travel joint is fully extended through its stroke, for example eighteen inches, and the clutch members are engaged for torque transmission.

When it is desired to land and latch the washpipe, tension loading is further applied to the work string, which causes the shear pins 762 to separate. The positive indicator shear ring 758 engages against the shoulder of the locator ring 754 and is displaced longitudinally along the carrier sleeve onto the radially stepped portion 722*b* of the carrier sleeve 722. When this occurs, the positive indicator ring 758 retracts radially inwardly, so that it can pass by the locator ring 754 without interference. At this time, the travel joint is fully expanded, and the assembly can then be used to land and latch the washpipe as previously discussed.

Figure 7:
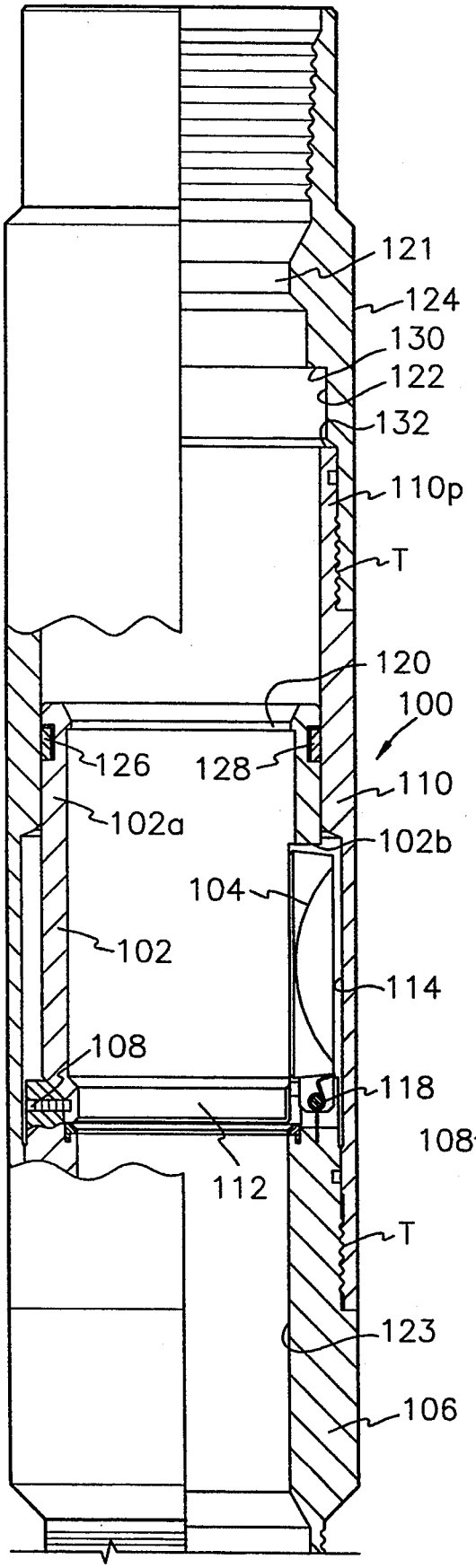
FIG. 7 is a longitudinal sectional view of a flapper valve constructed according to one aspect of the present invention, shown in the open position.
Figure 8:
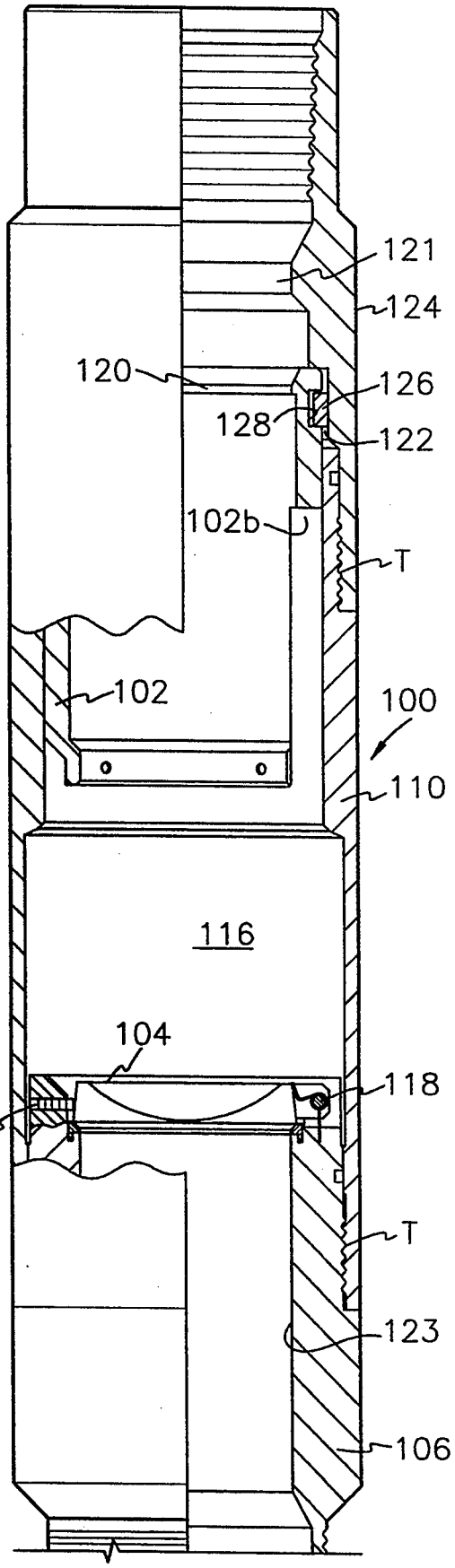
FIG. 8 is a view similar to FIG. 7, showing the flapper valve in the closed position.

Referring now to FIG. 7 and FIG. 8, a flapper valve assembly 100 constructed according to one aspect of the present invention is shown in valve open position for accommodating a sand control service operation. In this assembly, a cross-over tool (service seal unit) is landed within the packer. The packer has hydraulically-actuated slips which set the packer against the well bore of the tubular well casing. The cross-over tool is coupled to the packer while gravel slurry is pumped through a work string into the bore of the cross-over tool.

After the gravel pack procedure has been completed, the bore of the service tool is pressurized with clean-out fluid to remove excess slurry and to clean the work string bore. This is carried out with the sealing surfaces of the service tool engaged within the polish bore of the packer, and with the lateral flow passages of the cross-over tool positioned to admit flow of clean-out fluid. The clean-out fluid is circulated downwardly through the annulus intermediate to the well casing and the work string, with the clean-out fluid moving in reverse flow direction upwardly through the bore of the cross-over tool and through the work string.

Completion fluid and particulates in the casing annulus above the packer can flow into the production annulus and penetrate the formation. It is desirable to circulate the particulates and the completion fluid to the surface to prevent damage to the screen S and to avoid squeezing or otherwise disturbing the established position of the gravel pack. A commonly used completion fluid is aqueous calcium chloride, having a weight of approximately 11.5 pounds per gallon. It will be appreciated that a column of such completion fluid if unrestrained will penetrate the formation and possibly disturb the established gravel pack. The volume of the annulus between the production tubing and the well casing may be as much as 8 to 10 times greater than the volume of the production tubing, so that a considerable amount of valuable completion fluid will be lost if permitted to penetrate into the surrounding formation, and because of its strong pressure, may interfere with formation treatments such as acidizing deposits and gravel packs.

During the course of the well treatment operation, the flapper valve 100 is held in open position as shown in FIGS. 7 and 11 by a prop sleeve 102. Upon shifting of the prop sleeve 102, the valve closure element 104 moves automatically to the closed and sealed position as shown in FIG. 8, thereby containing the completion fluid and preventing it from release into the formation. With the flapper valve 100 thus protecting the formation, the clean-up operations, for example, cleaning up the well bore, can be carried out and the completion fluid can be recovered with the washpipe disengaged. After the completion fluid has been recovered, the work string is then retrieved from the well and a production tubing string is run into the well in its place. Such operations may take several days, during which time the formation is protected by the closed flapper valve 100.

Upon completion of clean-up operations and recovery of the completion fluid, the production string is inserted into the well and is coupled to the upper packer to provide for production from the formation to the surface. Before the onset of production operations, however, the flapper valve 100 must be reopened to permit formation fluids to be lifted to the surface.

In one class of flapper valves, the prop sleeve 102 is engaged by a tool such as a tail pipe or a wire line tool to return the valve closure member 104 to the valve open position. In another class of flapper valve construction, the valve closure member 104 is constructed so that it will be ruptured or otherwise destroyed in response to a mechanical or hydraulic opening force. The flapper valve closure member 104 is preferably constructed of a frangible material such as tempered glass which will rupture under an opening force to provide a fully opened bore through the production string. In some cases, the production string is provided with a tail pipe tool which effects destruction or opening of the frangible valve member. In other cases, the frangible valve member 104 is designed to rupture under the build-up of hydraulic pressure or in response to a downward penetrating force exerted by a wire line tool drop bar, or mule shoe on the end of the tubing string.

According to another aspect of the present invention, an improved flapper valve assembly 100 permits torquing operations through the entire flapper valve assembly. The flapper valve closure element is held in the open position by a prop sleeve 102. The prop sleeve 102 is releasably secured to the valve seat 106 by shear pins 108.

Referring now to FIG. 7, the flapper valve assembly 100 is interposed between the packer and the screen, and is mechanically attached by threaded connections at its upper end to the seal bore sub, and at its lower end to a lower extension sub. The flapper valve assembly 100 includes a valve seat sub 106 having male thread for engaging the lower extension sub. A valve housing sub 110 engages the valve seat sub 106 in threaded connection, and is provided with female threads for making a threaded union with the extension sub.

The valve seat sub 106 is provided with a fluid passage bore 112, and the valve housing sub 110 is provided with an enlarged bore 114 which defines a valve chamber 116 to accommodate movement of the flapper valve closure member 104 from the valve open position as shown in FIG. 7, to the valve close position as shown in FIG. 8.

According to an important aspect of this embodiment, the valve seat sub 106 is releasably secured to the prop sleeve 102 by the shear screws 108. By this arrangement, torque applied through the work string and flapper valve housing is decoupled from the prop sleeve 102, thereby preventing torque differentials between the prop sleeve and the valve seat housing which might damage the flapper valve hinge assembly.

According to another important aspect of this embodiment, the prop sleeve 102 has a tubular sidewall 102A which is intersected by a large radial opening 102B, thereby defining a sidewall pocket for receiving the flapper closure plate 104, as shown in FIG. 7. According to this arrangement, a full diameter flow bore is provided through the prop sleeve 102 and flapper valve assembly 100.

In the course of running the completion equipment into the well, and in particular through highly deviated or horizontal well bores as shown in FIG. 1*a*, it is necessary to push and torque the work string to obtain passage of the equipment through tight bores and other obstructions. Torque differentials applied across the completion equipment may cause damage and prevent proper operation of the equipment. The flapper valve assembly 100, and in particular its hinge assembly 118 is subject to such damage in response to a torque differential being applied across the prop sleeve 102 relative to the valve seat sub 106. Torque isolation for the prop sleeve 102 relative to the valve seat sub 106 is provided by a set of shear pins 108 which releasably couple the lower end of the prop sleeve 102 to the valve seat sub 106. According to this arrangement, there is no direct connection of the prop sleeve 102 to the valve housing sub 110. The valve housing sub 110 is coupled to the valve seat sub 106 by a threaded union T, which is longitudinally spaced and radially spaced from the hinge assembly 118. According to this arrangement, the prop sleeve 102 and the hinge assembly 118 are effectively decoupled with respect to torque differential forces.

The prop sleeve 102 is opened to the extended position as shown in FIG. 8 and FIG. 2F by engagement with the shifting tool 476. For this purpose, a radially inset profile shoulder 120 is provided on the upper end of the prop sleeve 102 for selective engagement with the key slot 492 of the shifting sleeve 476 (FIG. 2F). After engagement with the shifting tool, the prop sleeve 102 is extended into a counterbore 122 of a connector sub 124. The connector sub 124 is attached to the valve housing sub 110 by a threaded union T. The connector sub is intersected longitudinally by a flow bore 121 and by the longitudinal counterbore 12. The longitudinal flow bore 121 is in flow alignment with the flow bore 120 of the prop sleeve 120 and of the flow bore 123 of the valve housing sub 106. The prop sleeve 102 is retained in the extended, closed valve position as shown in FIG. 8 by a C-ring 126 which is carried in an annular slot 128 formed on the upper end of the prop sleeve 102. Upon entry of the prop sleeve into the counterbore 122, the C-ring 126 expands radially into engagement with the counterbore, and is captured between a counterbore shoulder 130 and the annular end face 132 of the housing sub pin connector 110T.

The travel joint assembly 710 and travel joint lock assembly 712 may be retrieved by an upward pull on the work string. As tension is applied through the work string, the shear pins 738 separate, thus providing separation and release of the coupling sleeve 738 from the tubular connector sub 740.

Once an earth well has been drilled and casing 11 has been cemented into place, the inner liner 12 is run through the bore of the casing and into the open or uncased portion of the well bore. A work string 19 is assembled, which has a float shoe 50 secured to its terminal end with a latch down collar 950 threadedly attached, a well filtration device such as one or more lengths of well screen S or slotted liner L, sleeve valve 450 and an appropriate number of lengths of blank pipe B are threadedly connected and hung off hydraulic packer 20. Additional lengths of blank pipe form the production tubing 19 between the hydraulic packer and the earth's surface where it is connected to a tubing hanger and ultimately to a christmas tree after the well is completed.

During run-in, a work string is concentrically disposed within the production string. The work string includes, from its lower end, a latch collet 925, threadedly connected to cup packer 80 having lower ball catcher sub 90 incorporated into its flow bore as discussed above. Threadedly connected to the cup packer is shear joint 701 which is connected by shearable means to a telescoping travel joint 550. The upper end of the telescoping travel joint is threadedly connected to the shifting tool 475 which is in turn threadedly connected to one end of the washpipe 401. Threadedly connected to the other end of the washpipe is collet catcher 315 which is disposed within the bore of hydraulic packer 20. Shearably attached to the upper end of the hydraulic packer is hydraulic setting tool 20 into which is threaded an upper work string comprising blank pipe which extends to the surface. Both the production tubing string with the work string concentrically disposed therein are run in the hole simultaneously.

As the production string begins to encounter resistance to run in as a result of debris, such as drill cuttings, left in the open portion of the hole, wash fluid is pumped down the work string under pressure. The hydraulic pressure forces open the conical check valve 520 and allows the fluid to escape under pressure through lower flow port 505 and lateral flow ports 510. As the fluid is jetted through the flow ports, the debris is washed away thereby allowing the downhole filtration device to be moved into the desired position in the well bore.

Once the production string is in the desired position, the drop ball A is introduced into the bore of the work string and pumped into sealing engagement with the C-ring 614 of the expendable plug assembly 60. Increasing fluid pressure on drop ball A causes the C-ring to press against hollow shear screw 626 which will shear upon the application of sufficient pressure thereby opening the flow port 230 of hydraulic setting tool 20. Continued application of pressure upon the work string forces internal C-ring ball seat 614 out of the longitudinal bore 612 of the external mounting collar 605 and allows the C-ring and shear collar together with the drop ball A to move into the tool string flow passage 232 until the shear collar lands on shoulder 624A.

Continued application of fluid pressure to the ball and the collet catcher forces the drop ball A into the bore of the collet catcher, causing the resilient elastomeric coating on the collet catcher to tear as discussed above, thereby permitting the outwardly biased ring collar 616 to spring outwardly and release drop ball A to fall into sealing engagement upon the upwardly extending resilient collet fingers 317 of collet catcher 315 as shown in FIG. 4B. Once the drop ball is in sealing engagement with the collet fingers, further increasing fluid pressure within the work string will set slips 310*a*, 310*b* and sealing element package 305 of the hydraulic packer 30 within casing 12.

Referring now to FIGS. 2B and 2H, once the hydraulic packer 30 is set, a further increase in pressure will cause shear pin 318 in the lower end of resilient collet fingers 317 of collet catcher 315 to shear and move down, allowing the fingers to spread thereby expelling drop ball A further down the bore of the work string and into the tapered bore seat 900 of lower ball catcher sub 930. The increased pressure will force the drop ball into sealing engagement with the tapered, inwardly sloping shoulder 900, as is depicted in FIG. 2H, and will also cause the material of drop ball A to extrude into the tapered seat. Completion of this sealing process, which is signaled to the operator on the surface by an increase in pump outlet pressure, will prevent the further discharge of fluid through the float shoe 50.

Once the float shoe 50 is sealed out of the system by the drop ball A, the fluid which is being pumped through the work string is directed through flow ports 808 of the cup packer 80.

Upon seeing the internal pressure rise indicating the sealing of float shoe 50, the operator will begin to pick up work string 18 with all of its component parts while simultaneously pumping fluid down the work string and out through ports 808. The pumped fluid will be forced out through downhole filtration devices, whether they be screens S, as is depicted in FIG. 1A or slotted liner L, as is depicted in FIG. 1B, or a combination of the two from the inside of the device to the outside thereof. Returns are carried up the annulus between the downhole filtration device and the well bore, through ports 454 of sleeve valve 450 and thereafter to the surface in the annulus between production tubing 19 and work string 18.

As the work string is withdrawn from the production tubing, upper element support 812*a* of cup packer 80 will engage the interior bore of lower restraining shoulder 462*b* in sleeve valve 450 thereby restricting any further upward motion of the work string. This contact will be signaled to the operator on the surface by an apparent increase in weight on the rig weight indicator. Continued upward pull will release the locking lugs in the telescoping travel joint 55. Once the lugs are released, the concentrically nested tubular portions of the telescoping joint will be pulled apart until the upper clutch 554 comes into contacting engagement with lower clutch 560.

Referring now to FIG. 2F, the upper clutch 554 is threadedly attached to inner travel tube 522 and is sealed against leakage by o-ring seal 572 which is carried in a groove milled into the upper clutch mandrel and compressed between the upper clutch mandrel and inner travel tube 522. Leakage between the outer travel tube 552 and the inner travel tube 554 is prevented by an o-ring seal 574 which is contained in a second groove milled into the opposite surface of the clutch mandrel and is maintained in sliding and sealing engagement with outer tube 552. The opposing clutch members 554 and 560 enter into restrictive, torque transmitting engagement with each other upon full stroke extension thereby preventing the complete extraction of the inner tube from within the outer tube. Again, when the torque clutches enter into engagement with each other, the operator on the surface will be signaled that the telescoping joint is fully expanded by an apparent increase in weight on the rig weight indicator.

Upon recognizing that the telescoping joint 710 has extended, the operator will then lower the work string while simultaneously pumping fluid which exits the work string through ports 808 in the cup packer 80 to continue backwashing the downhole filtration device. When the lower radially outwardly sloped shoulder 926 of latch collet 925 contacts hold down ramp 928 of latch down collar 936, this event will be signaled to the operator by an apparent weight decrease. The operator will then once again raise the work string while pumping fluid until the upper sealing means support 812*a* again contacts lower restraining shoulder 462*b* of sleeve valve 450.

Reciprocal motion of the work string between latch down collar 936 and sleeve valve 450 is continued while pumping fluid until a drop in indicated pump pressure at the surface indicates the downhole filtration device has been washed free of debris. When telescoping joint is telescoped, the washing has already been completed. At this time, it is ready to be lowered into the latch receptacle and packed.

Once the washing/sand control operations have been completed, the service tool is pulled upward to engage the positive indicator shear ring against the flow sub locator collar. This shears the set of shear pins in the release housing, releases the locking lugs and permits the travel joint to stroke out fully.

Continuing to pick up will shear the positive indicator shear ring. The travel joint link may be sized to allow for space out of the tools and to engage the ratch receptacle when the travel joint is fully stroked. A set of internal slips 732 hold the travel joint in the fully extended position once the mechanical lock is released.

The washpipe is latched onto a latch receptacle after performing washing/sand control operations with a releasable ratch-latch. After latch up, the service tool is retrieved to the surface, leaving the washpipe latched to the latch receptacle. As the assembly is raised from the packer, the shifting tool engages the prop sleeve of flapper and unprops flapper which allows it to close and engages the closing sleeve and shifts it to the closed position. The formation is then totally isolated from well bore fluids.

The washpipe tubing extends below the packer assembly when the gravel pack service tool is installed. After running and hanging off the screen, blank pipe and isolation washpipe assembly at the rotary, the complete packer assembly is picked up and made up to the washpipe and then to the blank pipe. The complete assembly is then run into the well bore, set and tested. Then, washing/sand control operations are performed. After reversing out, tension is applied to shear the reverse indicator. The tool is raised to engage the telescoping joint indicator. Pins are sheared, allowing unpropping of locking lugs and expansion of the telescoping joint. Internal slips keep the telescoping joint from retracting. The service tool assembly is then slacked back onto the packer, allowing the ratch latch running tool to engage the ratch nipple profile. Further downward motion will unprop the running tool, activating the shear pins. After latch up, upward pull will shear the shear pins, releasing the ratch running tool from the ratch locator. Continued pickup will shear the indicator ring, allowing the service tool to be removed from the packer bore.

It will be apparent that a combination wash down/-gravel pack system has been provided which uses the basic components of an isolation washpipe system for adding a washing capability while running the gravel pack assembly to the producing zone. By providing an open bore through the entire length of the service tool and extending the lower set of seals on a washpipe isolation string into the lower seal bore, pressure integrity exists through the entire assembly. An additional trip to wash out the prepacked sand prior to running the screen assembly is not necessary. In horizontal completions, the travel joint and locking assembly is used to run washing assemblies that are too large to pull through the packer bore. Upon completion of washing, the travel joint is extended, the locking lugs are released, and the washing tool is latched at the bottom of the completion. The work string may then be retrieved to the surface. Thus, multiple trip completions may be performed in a single trip. Completion fluid loss is minimized by the flapper valve assembly which is set in place prior to pulling the work string to the surface.

We claim:

1. Setting apparatus for selectively applying hydraulic pressure to a hydraulically operated well completion apparatus comprising, in combination:

a tubular mandrel having a flow bore;

a guide tube received within the flow bore of tubular mandrel, said guide tube having an internal bore which is radially inset with respect to the flow bore, and said guide tube being radially intersected by a setting port;

an outwardly biased split C-ring having a bore passage therethrough and having an annular seat for engaging a drop ball, said C-ring being disposed for longitudinal movement within the bore of the guide tube;

a shear sleeve disposed in slidable engagement against the internal bore of the guide tube;

means coupled to the shear sleeve and to the guide tube for sealing the setting port when the shear sleeve is in a closed port, run-in position; and a shearable member coupled to said shear sleeve and guide tube for restricting longitudinal movement of the shear sleeve relative to the guide tube.

2. Setting apparatus as defined in claim 1, said sealing means including first and second longitudinally spaced annular seal members disposed in slidable, sealing engagement between the shear sleeve and the bore of the guide tube, said first and second annular seal members being disposed at longitudinally spaced locations on opposite sides of the setting ports when the shear sleeve is in the closed port position.

3. Setting apparatus as defined in claim 1, wherein shearable member is disposed in the setting port, said shearable member being intersected by a longitudinal blind bore which serves as an open flow passage through the body of the shearable member when the shearable member has been separated by a shearing force.

4. Setting apparatus as defined in claim 1, wherein said guide tube is intersected by a longitudinal counterbore, said shear sleeve being received within said counterbore.

5. Setting apparatus as defined in claim 1, wherein said shear sleeve is releasably coupled to the guide tube by a hollow shear screw, said hollow shear screw bearing received within said setting port.

6. A method of performing a downhole operation in a well bore by pumping fluid through a tubing string located in the well bore, comprising the steps of:

isolating a port from the interior of the tubing string with a shear sleeve;

dropping a ball into the tubing string and landing the ball on an outwardly biased split C-ring valve member;

applying fluid pressure through the tubing string to drive the C-ring valve member against the shear sleeve, and open the port to fluid flow;

injecting fluid through the exposed port to perform a selected operation in the well bore;

driving the C-ring valve member into a counterbore and permitting it to expand; and expending the ball through the bore of the expanded C-ring valve member.

7. A method of setting a packer which is coupled to a tubing string, comprising the steps of:

isolating a packer setting port from the interior of the tubing string with a shear sleeve;

dropping a ball into the tubing string and landing the ball on an outwardly biased, split C-ring valve member;

applying fluid pressure through the tubing string to drive the C-ring valve member against the shear sleeve and open the setting port to fluid flow;

injecting fluid through the exposed port to set the packer;

increasing the fluid pressure to separate the shear sleeve and allow the C-ring valve member to expand into an annular recess; and, expending the ball through the bore of the expanded C-ring valve member.

8. A method for setting a packer having a pressure chamber and setting ports coupled to a tubing string comprising the steps:

covering setting ports with a shear sleeve;

dropping a ball into the tubing string and landing it on an outwardly biased, split C-ring valve member;

increasing the hydraulic setting pressure to shift the shear sleeve and C-ring valve member to an uncovered port position;

injecting the hydraulic setting fluid into the packer pressure chamber through the exposed port;

increasing the hydraulic setting pressure to separate the C-ring and shear sleeve for travel along the tubing string;

expanding the C-ring valve member into a counterbore; and, moving the ball through the bore of the expanded C-ring valve member.

9. A flapper valve assembly for protecting a well formation during a well completion operation comprising, in combination:

a tubular valve seat sub having a bore defining a fluid flow passage and having a counterbore defining a pocket for receiving a prop sleeve;

a tubular valve housing sub having a bore defining a fluid flow passage and mateable with said tubular valve seat sub;

a valve closure plate mounted on said valve seat body for pivotal movement between valve open and closed positions for preventing flow through said flow passage when said closure plate is in the closed position;

a tubular prop sleeve having a first end portion disposed within the valve seat counterbore, said closure plate being confined between the prop sleeve and the tubular valve housing in the valve open position; and a shearable member connecting the prop sleeve to the valve seat sub for releasably securing the prop sleeve in the valve open position.

10. A flapper valve assembly as defined in claim 9, including:

a tubular connector sub coupled to the tubular valve housing sub, said tubular connector sub having a bore defining a fluid flow passage and having a counterbore for receiving the tubular prop sleeve in the valve closed position.

11. A flapper valve assembly as defined in claim 9, said tubular prop sleeve having a second tubular end portion received within the bore of the tubular valve housing sub, the second end portion having an annular slot and an outwardly biased expandable C-ring confined within the annular slot by the sidewall of the tubular valve housing sub.

12. A flapper valve assembly as defined in claim 9, wherein the tubular prop sleeve has a second tubular end portion received within the bore of the tubular valve housing sub, said second tubular end portion having an annular shoulder projecting into the bore of the prop sleeve, said shoulder having a predetermined profile for engagement with a shifting tool.

13. A flapper valve as define in claim 9, wherein the tubular prop sleeve has a tubular sidewall, said tubular sidewall being intersected by a radial opening defining a recess for receiving the valve closure plate in the valve open position.

14. A shifting tool for selectively engaging shiftable well completion apparatus comprising, in combination:

a tubular mandrel having a longitudinal flow bore, said tubular mandrel being adapted for interconnection in a tubing string, and said tubular mandrel being intersected by a longitudinal slot defining a deflection chamber;

a key plate disposed for radial movement within the deflection chamber;

first and second retainer means coupled to said mandrel on opposite ends of the deflection chamber for limiting radial outward deflection of the key plate relative to the mandrel; and, compression spring means interposed between the shifting tool mandrel and the key plate for resiliently opposing inward radial deflection of the key plate relative to the shifting tool mandrel.

15. A shifting tool as defined in claim 14, said key plate having first and second radially projecting key members, said radially projecting key members being longitudinally separated by an annular slot, said annular slot defining a detent for receiving an engagement shoulder of shiftable well completion apparatus.

16. A shifting tool as defined in claim 14, wherein each key of the shifting tool has a predetermined profile and longitudinal separation with respect to adjacent keys which permits selective engagement of the tool with shiftable well completion apparatus.

17. A shifting tool as defined in claim 14, wherein one of said retainer means includes a set of shear pins which permit emergency separation and release of the key plate from the shifting tool mandrel.

18. A positive latch assembly for releasably connecting a washpipe to a tubular flow conductor comprising, in combination:

a tubular latch receptacle having a first end portion adapted for coupling attachment to the tubular flow conductor, the tubular latch receptacle having an internal latch surface for engaging a latching member, the internal latch surface being intersected by helical threads;

a tubular collet adapted for coupling attachment to a washpipe, the collet having a tubular body portion adapted for insertion into the latch bore of the latch receptacle, the tubular body portion including a sidewall portion which is intersected radially by helical threads and intersected by longitudinal slots, thereby defining deflection segments, wherein the helical threads on the tubular collet sidewall body portion are adapted for threaded engagement with the helical threads on the latch receptacle.

19. A positive latch assembly as defined in claim 18, wherein the helically threaded tubular body portion is mounted on a relatively thin tubular mandrel, said tubular mandrel being intersected by a longitudinal flow bore and being intersected by an intermediate, longitudinally extending counterbore.

20. A positive latch assembly as defined in claim 18, said tubular seal mandrel having a radially projecting shoulder for engaging the tubular seal receptacle at the limit of threaded insertion engagement of the tubular seal mandrel within the tubular seal receptacle.

21. In well completion apparatus for completing a deviated or horizontal well, in which a tailpipe is supported within a flow conductor across downhole filtration means, the improvement comprising a ball catcher sub connected in the washpipe tubing, said ball catcher sub having a mandrel portion characterized by a tapered bore, in which the tapered bore converges to a diameter which is less than the diameter of a selected drop ball.

22. A ball seat assembly as defined in claim 20, including a drop ball having a diameter exceeding the convergent diameter of the tapered bore, said drop ball being constructed of a ductile metal selected from the group consisting of lead and brass.

23. Apparatus for releasably locking an expandable travel joint of the type having an inner travel joint tube received for telescoping movement within an outer travel joint tube comprising, in combination:

a tubular lock mandrel having a longitudinal flow bore and a first end portion adapted for connection with the washpipe tubing and having a second end portion adapted for attachment to the inner travel joint tube, the lock mandrel having first and second mandrel support surfaces, the second mandrel support surface being radially stepped with respect to the first mandrel support surface, and the first mandrel support surface being intersected by a slot for receiving a locking lug;

a tubular coupling sleeve mounted for slidable movement on the tubular mandrel, the tubular coupling sleeve being adapted for attachment to the outer travel joint tube, said tubular coupling sleeve having a counterbore defining a pocket for receiving a ratchet slip;

a ratchet slip received within said pocket, said ratchet slip having tooth portions oriented to permit one-way movement of the ratchet slip relative to the lock assembly mandrel;

a tubular extension sleeve connected to the tubular coupling sleeve, the tubular extension sleeve having a first tubular body portion adapted for sliding movement along the lock assembly mandrel and having a second tubular body portion radially spaced from the locking assembly mandrel by a longitudinal counterbore, the second tubular portion being intersected by a slot for receiving a locking lug;

a locking lug received within the slot in the first large diameter support mandrel surface;

a tubular carrier sleeve mounted on the large diameter mandrel surface, and a tubular extension connected to the tubular carrier sleeve mounted on the tubular extension sleeve and confining the locking lug in said slot, and including a shear screw releasably connecting the tubular extension of the tubular carrier to the tubular extension sleeve;

a positive indicator shear ring mounted on the tubular carrier sleeve;

a retainer collar mounted on the tubular carrier sleeve for limiting longitudinal movement of the positive indicator shear ring relative to the tubular carrier sleeve, and shearable means connecting the shear sleeve to the tubular carrier sleeve;

a tubular prop sub mounted on the large diameter portion of the travel joint lock mandrel, the tubular prop sub including a tubular prop;

a tubular connector sub mounted on the lock mandrel and having an end portion adapted for threaded connection with the washpipe, said tubular connector sub having a counterbore for receiving the prop sub;

a C-ring disposed within the counterbore of the tubular connector sub, said C-ring being supported in a propped position by said prop; and, a release coupling sleeve disposed within the counterbore of the tubular connector sub, said release coupling sleeve being disposed in threaded engagement with the lock mandrel, and including shearable means releasably connecting the tubular connector sub to said release coupling sleeve.

* * * * *